US010688802B2

(12) United States Patent
Kimura

(10) Patent No.: US 10,688,802 B2
(45) Date of Patent: Jun. 23, 2020

(54) DIAPHRAGM PUMP, PUMP UNIT, AND INKJET PRINTER

(71) Applicant: MIMAKI ENGINEERING CO., LTD., Nagano (JP)

(72) Inventor: Toshihiro Kimura, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/392,614

(22) Filed: Apr. 23, 2019

(65) Prior Publication Data

US 2019/0329565 A1 Oct. 31, 2019

(30) Foreign Application Priority Data

Apr. 27, 2018 (JP) ..... 2018-086694

(51) Int. Cl.
*B41J 2/175* (2006.01)
*B41J 29/13* (2006.01)
(Continued)

(52) U.S. Cl.
CPC ..... *B41J 2/17596* (2013.01); *B41J 2/16508* (2013.01); *B41J 2/16526* (2013.01); *B41J 2/17509* (2013.01); *B41J 29/02* (2013.01); *B41J 29/13* (2013.01); *F04B 9/042* (2013.01); *F04B 23/06* (2013.01); *F04B 43/02* (2013.01); *F04B 43/026* (2013.01); *F04B 43/028* (2013.01); *F04B 43/04* (2013.01); *F04B 43/14* (2013.01); *F04B 53/16* (2013.01)

(58) Field of Classification Search
CPC .... B41J 2/16508; B41J 2/16526; B41J 2/175; B41J 2/17509; B41J 2/17596; B41J 29/02; B41J 29/13; F04B 9/042; F04B 23/06; F04B 43/02; F04B 43/026; F04B 43/028; F04B 43/04; F04B 43/14; F04B 53/16
See application file for complete search history.

(56) References Cited

U.S. PATENT DOCUMENTS 3,950,761 A * 4/1976 Kashio ..... B41J 2/175 347/85
6,312,116 B2 * 11/2001 Underwood ..... B41J 2/17513 347/86
(Continued)

FOREIGN PATENT DOCUMENTS

JP 2012225499 11/2012

*Primary Examiner* — Anh T Vo
(74) *Attorney, Agent, or Firm* — JCIPRNET

(57) ABSTRACT

A diaphragm pump, a pump unit and an inkjet printer are provided. A housing of the diaphragm pump includes: a circular supporting groove portion for supporting a supported portion, and a passage opening for passing the supported portion to the supporting groove portion in a direction indicated by an arrow, where a shape of an outer edge of a cross section of the supported portion orthogonal to the direction indicated by an arrow is a shape of an outer edge of a circle in which a part of the outer edge is missing. A width of the passing opening at a coupling portion of the supporting groove portion and the passing opening is greater than or equal to a minimum width of the supported portion in the direction orthogonal to the direction indicated by the arrow and smaller than a maximum width of the supported portion in the relevant direction.

12 Claims, 18 Drawing Sheets

(51) Int. Cl.

| | |
|---|---|
| ***B41J 2/165*** | (2006.01) |
| ***F04B 43/02*** | (2006.01) |
| ***F04B 43/04*** | (2006.01) |
| ***F04B 43/14*** | (2006.01) |
| ***F04B 23/06*** | (2006.01) |
| ***F04B 9/04*** | (2006.01) |
| ***B41J 29/02*** | (2006.01) |
| ***F04B 53/16*** | (2006.01) |

(56) References Cited

U.S. PATENT DOCUMENTS

| | | | | |
|---|---|---|---|---|
| 2017/0211570 | A1* | 7/2017 | Yajima | F04B 43/08 |
| 2018/0056663 | A1* | 3/2018 | Asawa | F04B 43/02 |

* cited by examiner

DIAPHRAGM PUMP, PUMP UNIT, AND INKJET PRINTER

CROSS REFERENCE TO RELATED APPLICATIONS

This application claims the priority benefit of Japanese Patent Application No. 2018-086694, filed on Apr. 27, 2018. The entirety of the above-mentioned patent application is hereby incorporated by reference herein and made a part of this specification.

TECHNICAL FIELD

The present disclosure relates to a diaphragm pump including a diaphragm, a pump unit, and an inkjet printer.

DESCRIPTION OF THE BACKGROUND ART

As a conventional diaphragm pump, a diaphragm pump including a substantially rectangular parallelepiped housing and a stepping motor projecting out from the housing (see e.g., Japanese Unexamined Patent Publication No. 2012-225499). The housing described in Japanese Unexamined Patent Publication No. 2012-225499 includes a housing main body, an upper cover that covers an upper opening of the housing main body, a flow path structural body that covers a lower opening of the housing main body and formed with a flow path that allows liquid to flow therethrough.

The diaphragm pump described in Japanese Unexamined Patent Publication No. 2012-225499 includes a diaphragm between the housing main body and the flow path structural body, the diaphragm having an annular portion of the outer periphery sandwiched between a bottom portion of the housing main body and an upper portion of the flow path structural body over the entire periphery. The diaphragm opens and closes the flow path formed in the flow path structural body as the central portion moves in a vertical direction.

The diaphragm pump described in Japanese Unexamined Patent Publication No. 2012-225499 includes a valve shaft extending in the vertical direction and integrally connected to the central portion of the diaphragm and a coil spring that biases the valve shaft toward the lower side in the vertical direction in a space between the housing main body and the upper cover. The valve shaft includes a protrusion projecting out toward the outer peripheral side.

The diaphragm pump described in Japanese Unexamined Patent Publication No. 2012-225499 includes a swing member in a space between the housing main body and the upper cover, the swing member including a supporting shaft extending in the horizontal direction and rotatably supported by the housing main body, an output portion projecting out toward the outer peripheral side from the supporting shaft to contact the protrusion of the valve shaft from the lower side, and a plate-shaped protrusion projecting out toward a side opposite to the output portion from the supporting shaft.

The diaphragm pump described in Japanese Unexamined Patent Publication No. 2012-225499 includes a camshaft in a space between the housing main body and the upper cover, the camshaft including a shaft portion extending in parallel to the supporting shaft of the swing member and rotatably supported by the housing main body and a cam portion projecting out toward the outer peripheral side from the shaft portion to contact the plate-shaped protrusion of the swing member from the upper side. The shaft portion is rotationally driven by a stepping motor.

The diaphragm pump described in Japanese Unexamined Patent Publication No. 2012-225499 may not operate normally if flapping of the camshaft occurs in a direction orthogonal to the extending direction of the camshaft. In the diaphragm pump described in Japanese Unexamined Patent Publication No. 2012-225499, the flapping of the camshaft in the vertical direction is prevented as the housing main body supports the camshaft by a groove portion in which the upper side in the vertical direction is opened and extends in the vertical direction, and the camshaft is pressed by the upper cover from the upper side in the vertical direction of the groove portion with the camshaft supported by the groove portion.

SUMMARY

However, the conventional diaphragm pump has a problem in that a member for pressing the camshaft is necessary in addition to the member for supporting the camshaft.

The present disclosure provides a diaphragm pump, a pump unit, and an inkjet printer capable of simplifying, compared to a conventional art, a structure for suppressing flapping of a camshaft in a direction orthogonal to an extending direction of a camshaft.

A diaphragm pump according to the present disclosure includes a diaphragm, a camshaft including a cam for driving the diaphragm; and a housing that rotatably supports the camshaft; where the camshaft includes a supported portion to be supported by the housing; the housing includes a supporting groove portion with a circular shape for supporting the supported portion, and a passage opening for passing the supported portion to the supporting groove portion in a direction orthogonal to an extending direction of the camshaft; a shape of an outer edge of a cross section of the supported portion orthogonal to the extending direction is a shape of an outer edge of a circle in which a part of the outer edge is missing; and a width of the passing opening at a coupling portion of the supporting groove portion and the passing opening is greater than or equal to a minimum width of the supported portion in the orthogonal direction and smaller than a maximum width of the supported portion in the orthogonal direction.

According to such a configuration, in the diaphragm pump of the present disclosure, when the supported portion of the camshaft is supported by the supporting groove portion by causing the supported portion of the camshaft to pass through the passage opening, the supported portion of the camshaft cannot exit from the passage opening unless the rotation angle of the camshaft is a specific angle, and thus the structure for suppressing the flapping of the camshaft in the direction orthogonal to the extending direction of the camshaft can be simplified compared to the conventional structure.

In the diaphragm pump of the present disclosure, the passage opening may extend from an upper side of the supporting groove portion in a vertical direction to the supporting groove portion in the vertical direction.

According to such a configuration, in the diaphragm pump of the present disclosure, the own weight of the camshaft is applied on the camshaft in a direction opposite to the moving direction of the camshaft for the supported portion of the camshaft to exit from the supporting groove portion to the passage opening, and thus it becomes difficult for the supported portion of the camshaft to exit from the supporting groove portion to the passage opening, and as a result, the flapping of the camshaft in the vertical direction can be more firmly suppressed.

The diaphragm pump of the present disclosure may further include a pusher for pushing the diaphragm in the vertical direction. The cam may contact the pusher from a lower side in the vertical direction.

According to such a configuration, in the diaphragm pump of the present disclosure, the weight of the pusher is applied on the camshaft in a direction opposite to the moving direction of the camshaft for the supported portion of the camshaft to exit from the supporting groove portion to the passage opening, and thus it becomes difficult for the supported portion of the camshaft to exit from the supporting groove portion to the passage opening, and as a result, the flapping of the camshaft in the vertical direction can be more firmly suppressed.

A pump unit of the present disclosure includes a plurality of diaphragm pumps described above, where the camshaft of each of the plurality of diaphragm pumps is coupled to the camshaft of another diaphragm pump in the extending direction thereof, and the camshafts of at least two diaphragm pumps among the plurality of diaphragm pumps have positions of the supported portions in a rotating direction shifted from each other.

According to such a configuration, in the pump unit of the present disclosure, in a case where a rotation angle of the camshaft reached an angle for the supported portion of the camshaft of any one diaphragm pump to exit from the supporting groove portion to the passage opening, a rotation angle of the camshaft does not become an angle for the supported portion of the camshaft of another at least one diaphragm pump to exit from the supporting groove portion to the passage opening, and thus it becomes difficult for the supported portion of the camshaft to exit from the supporting groove portion to the passage opening, and as a result, the flapping of the camshaft in the vertical direction can be more firmly suppressed.

The inkjet printer of the present disclosure is characterized in that ink is transferred by the above-described diaphragm pump.

According to such a configuration, the inkjet printer of the present disclosure can simplify, compared to the conventional art, a structure for suppressing flapping of a camshaft in a direction orthogonal to an extending direction of a camshaft of a diaphragm pump.

The inkjet printer of the present disclosure is characterized in that ink is transferred by the above-described pump unit.

According to such a configuration, the inkjet printer of the present disclosure can simplify, compared to the conventional art, a structure for suppressing flapping of a camshaft in a direction orthogonal to an extending direction of a camshaft of a pump unit.

The diaphragm pump, the pump unit, and the inkjet printer of the present disclosure can simplify the structure for suppressing the flapping of the camshaft in the direction orthogonal to the extending direction of the camshaft compared to the conventional art.

DESCRIPTION OF EMBODIMENTS

Hereinafter, one embodiment of the present disclosure will be described with reference to the drawings.

First, the configuration of an inkjet printer according to the present embodiment will be described.

Figure 1:
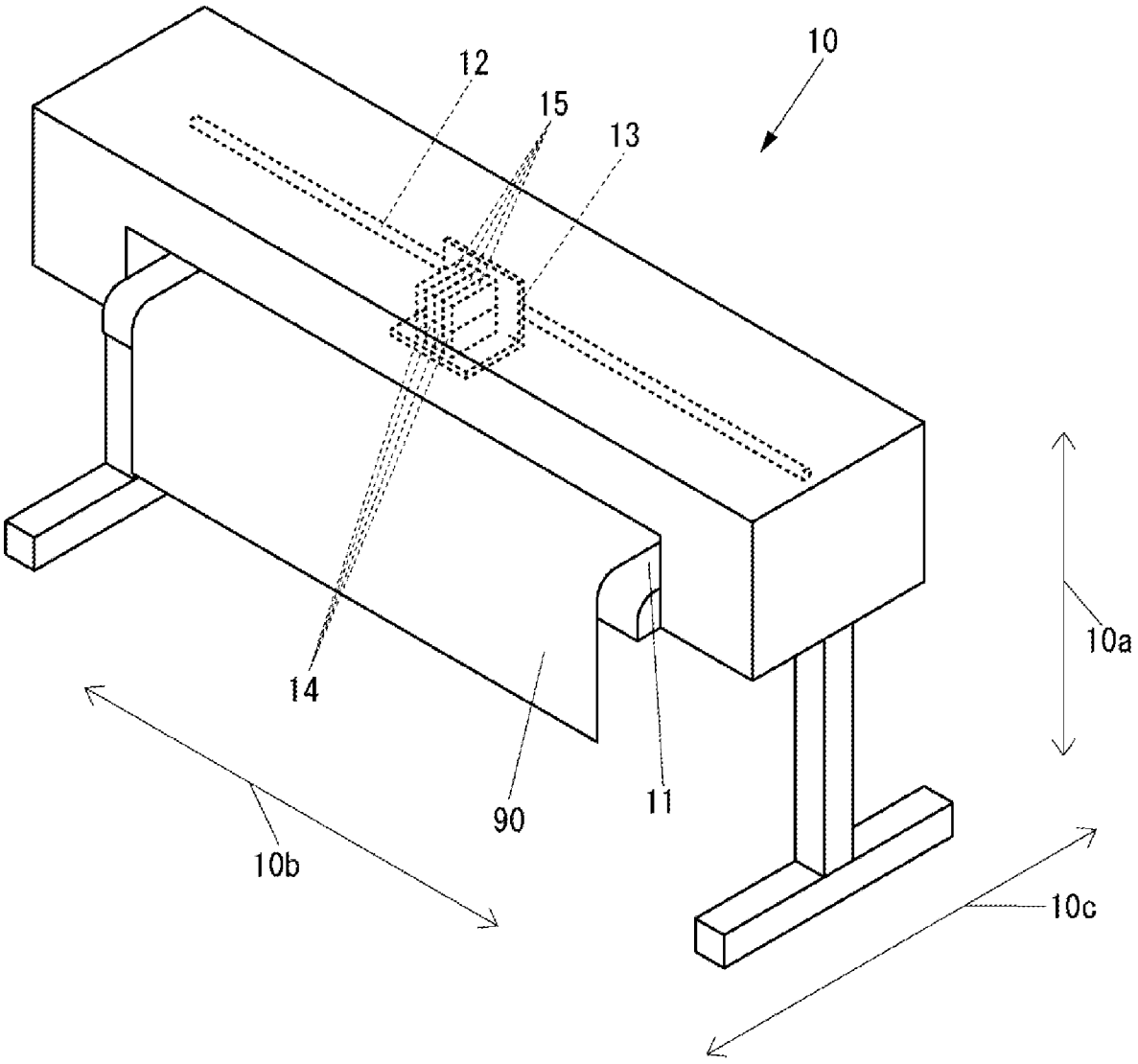
FIG. 1 is a perspective view of an outer appearance of an inkjet printer according to one embodiment of the present disclosure.

FIG. 1 is a perspective view of an outer appearance of an inkjet printer 10 according to the present embodiment.

As shown in FIG. 1, an inkjet printer 10 includes a platen 11 that supports a medium 90 from the lower side in a vertical direction indicated by an arrow 10*a*, a rail 12 that is disposed on the upper side in the vertical direction with respect to the platen 11 and extending in a left and right direction indicated by an arrow 10*b* orthogonal to the vertical direction, a carriage 13 supported so as to be movable in a direction indicated by the arrow 10*b* by the rail 12, a plurality of inkjet heads 14 that are mounted on the carriage 13 and eject ink toward the medium 90, and a plurality of dampers 15 that are mounted on the carriage 13 and form a meniscus in a concave state in the nozzles of the inkjet head 14 by making the pressure of the ink inside the inkjet head 14 a negative pressure. Various colors can be adopted as the color of the ink ejected by the inkjet head 14. One damper 15 is connected to each of the plurality of inkjet heads 14.

The medium 90 is conveyed to the platen 11 by a medium conveying device to be described later in a direction indicated by an arrow 10*c* orthogonal to both the direction indicated by the arrow 10*a* and the direction indicated by the arrow 10*b*.

Figure 2:
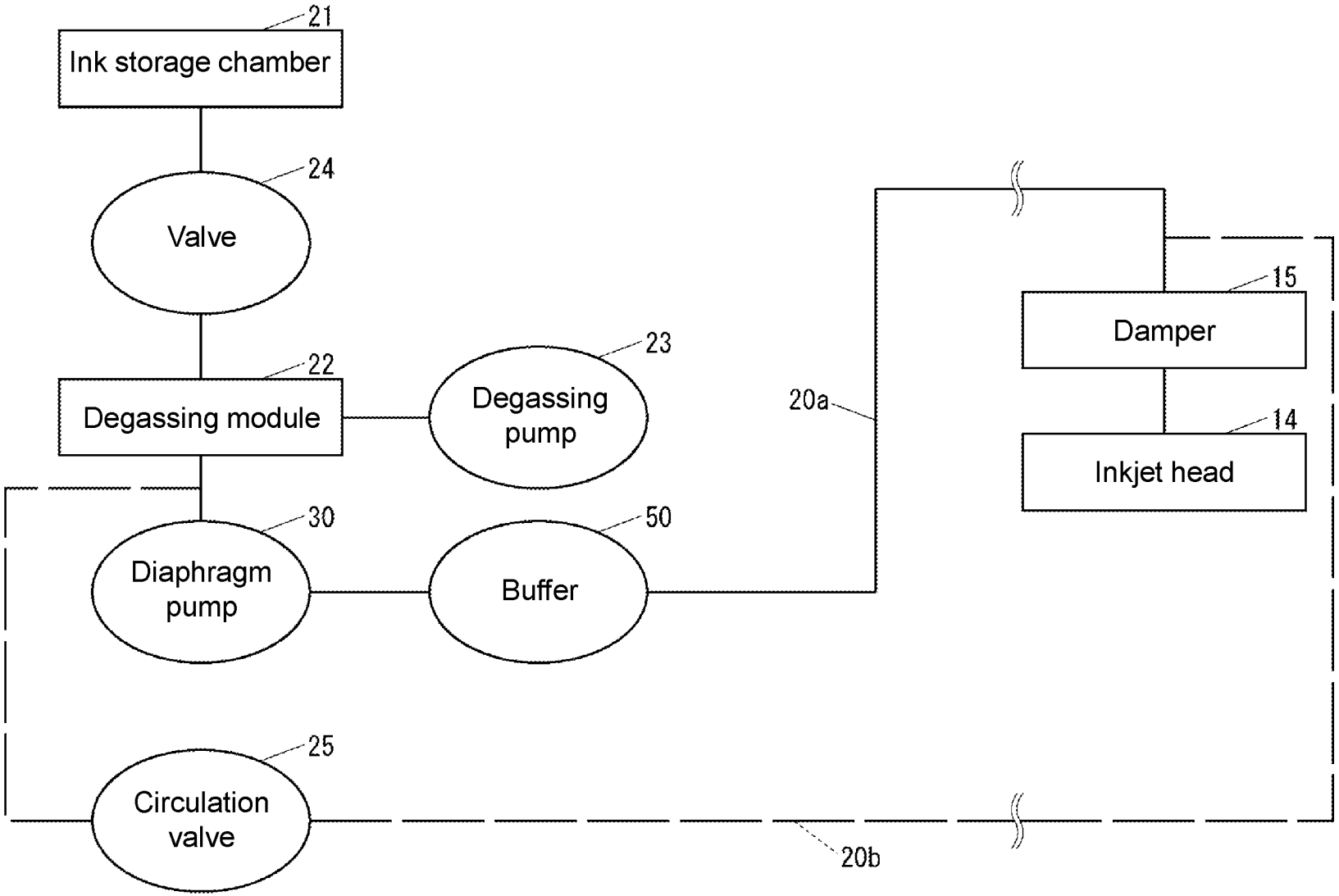
FIG. 2 is a view showing a path of ink in the inkjet printer shown in FIG. 1.

FIG. 2 is a diagram showing a path of ink in the inkjet printer 10.

As shown in FIG. 2, the inkjet printer 10 includes an ordinary path 20*a* of ink and a circulation path 20*b* used to circulate ink for the purpose of preventing sedimentation of particles in the ink or the like.

The inkjet printer 10 includes an ink storage chamber 21 such as a pack or a cartridge for storing ink, a degassing module 22 for removing oxygen in the ink supplied from the ink storage chamber 21, and a degassing pump 23 for making a part of the inside of the degassing module 22 in a vacuum state for degassing by the degassing module 22. In a case where oxygen is contained in the ink, the oxygen contained in the ink become air bubbles when the ink is ejected from the nozzle by the inkjet head 14, which causes ink ejection failure in the inkjet head 14. The degassing module 22 is provided to suppress the occurrence of such ejection failure.

The inkjet printer 10 includes a valve 24 that is disposed between the ink storage chamber 21 and the degassing module 22 in a path 20*a* and capable of opening and closing the path 20*a* by electrical control and a circulation valve 25 capable of opening and closing the circulation path 20*b* by electrical control.

The inkjet printer 10 includes a diaphragm pump 30 disposed between the damper 15 and the degassing module 22 in the path 20*a* to transfer ink and a buffer 50 disposed between the damper 15 and the diaphragm pump 30 in the path 20*a* to store ink. The buffer 50 is provided to be able to supply ink toward the damper 15 side even during a period in which the diaphragm pump 30 is not driven.

In FIG. 2, only the path communicating with one inkjet head 14 is shown. Actually, the inkjet printer 10 includes a path as shown in FIG. 2 for every inkjet head 14. That is, the inkjet printer 10 includes one of each of the damper 15, the ink storage chamber 21, the degassing module 22, the degassing pump 23, the valve 24, the circulation valve 25, the diaphragm pump 30, and the buffer 50 for every inkjet head 14. The ink storage chamber 21, the degassing module 22, the degassing pump 23, the valve 24, the circulation valve 25, the diaphragm pump 30, and the buffer 50 are not mounted on the carriage 13.

Figure 3:
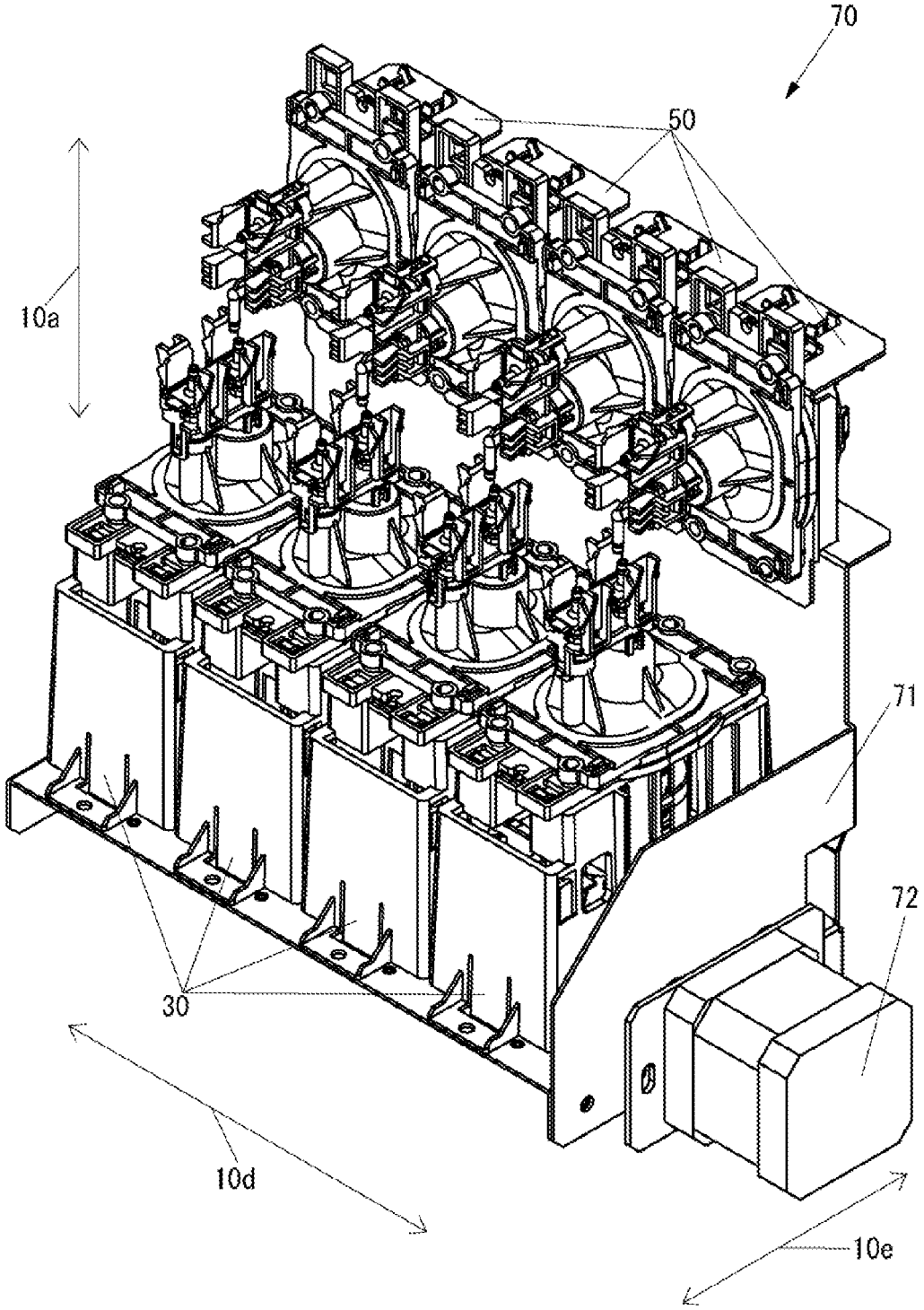
FIG. 3 is a perspective view of an outer appearance of a pump unit including a diaphragm pump shown in FIG. 2 and a buffer.

FIG. 3 is a perspective view of an outer appearance of a pump unit 70 including the diaphragm pump 30 and the buffer 50.

In the inkjet printer 10, the pump unit 70 is mounted in the state shown in FIG. 3.

As shown in FIG. 3, the pump unit 70 includes a unit base 71, four diaphragm pumps 30 fixed to the unit base 71, four buffers 50 fixed to the unit base 71, and a stepping motor 72 for driving the diaphragm pump 30, the stepping motor being fixed to the unit base 71.

The four diaphragm pumps 30 are arranged side by side in a direction indicated by an arrow 10*d* orthogonal to the vertical direction indicated by the arrow 10*a*. Here, the direction indicated by the arrow 10*d* may be either one of the directions indicated by the arrow 10*b* and the direction indicated by the arrow 10*c*, or neither the direction indicated by the arrow 10*b* nor the direction indicated by the arrow 10*c*.

The buffer 50 is disposed on the upper side in the vertical direction with respect to the diaphragm pump 30.

The pump unit 70 includes four sets of combination of the diaphragm pump 30 and the buffer 50 in FIG. 3. However, the pump unit 70 may include only one set or a plurality of sets other than four set of the diaphragm pump 30 and the buffer 50.

Figure 4:
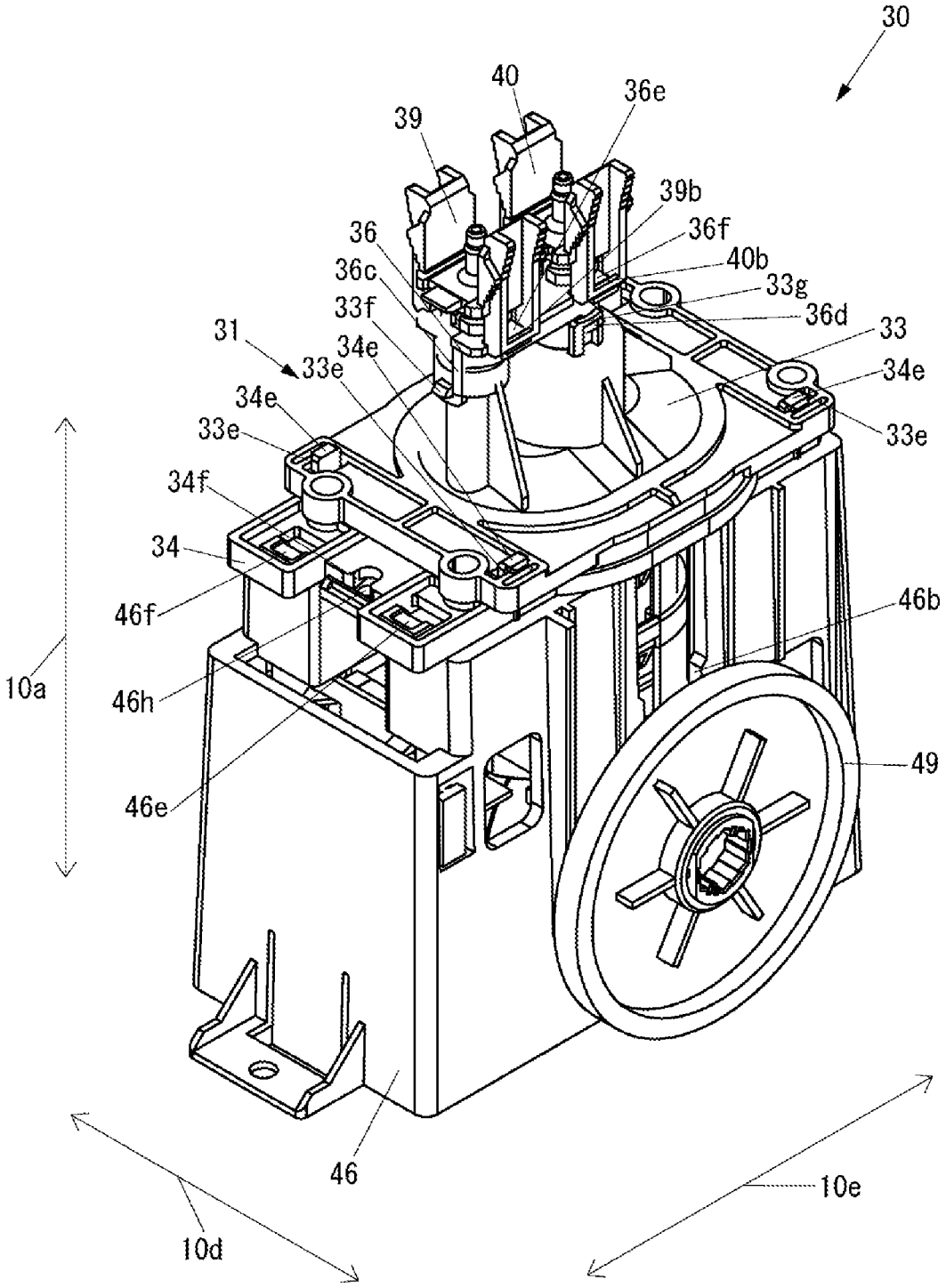
FIG. 4 is a perspective view of an outer appearance of the diaphragm pump shown in FIG. 3.
Figure 5:
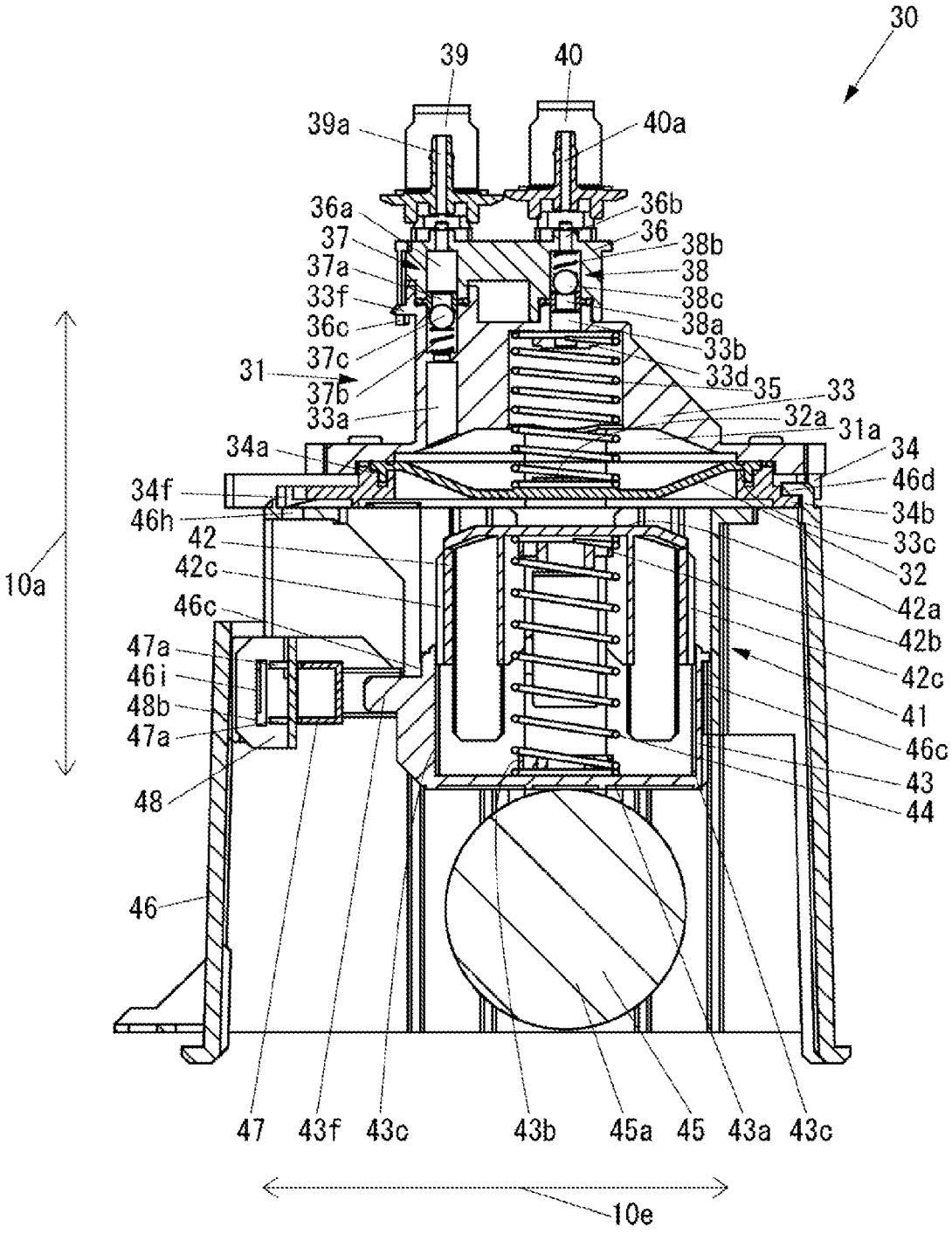
FIG. 5 is a side cross-sectional view of the diaphragm pump shown in FIG. 4 in a state in which an ink storage chamber is expanded and a pusher is not in contact with the diaphragm.
Figure 6:
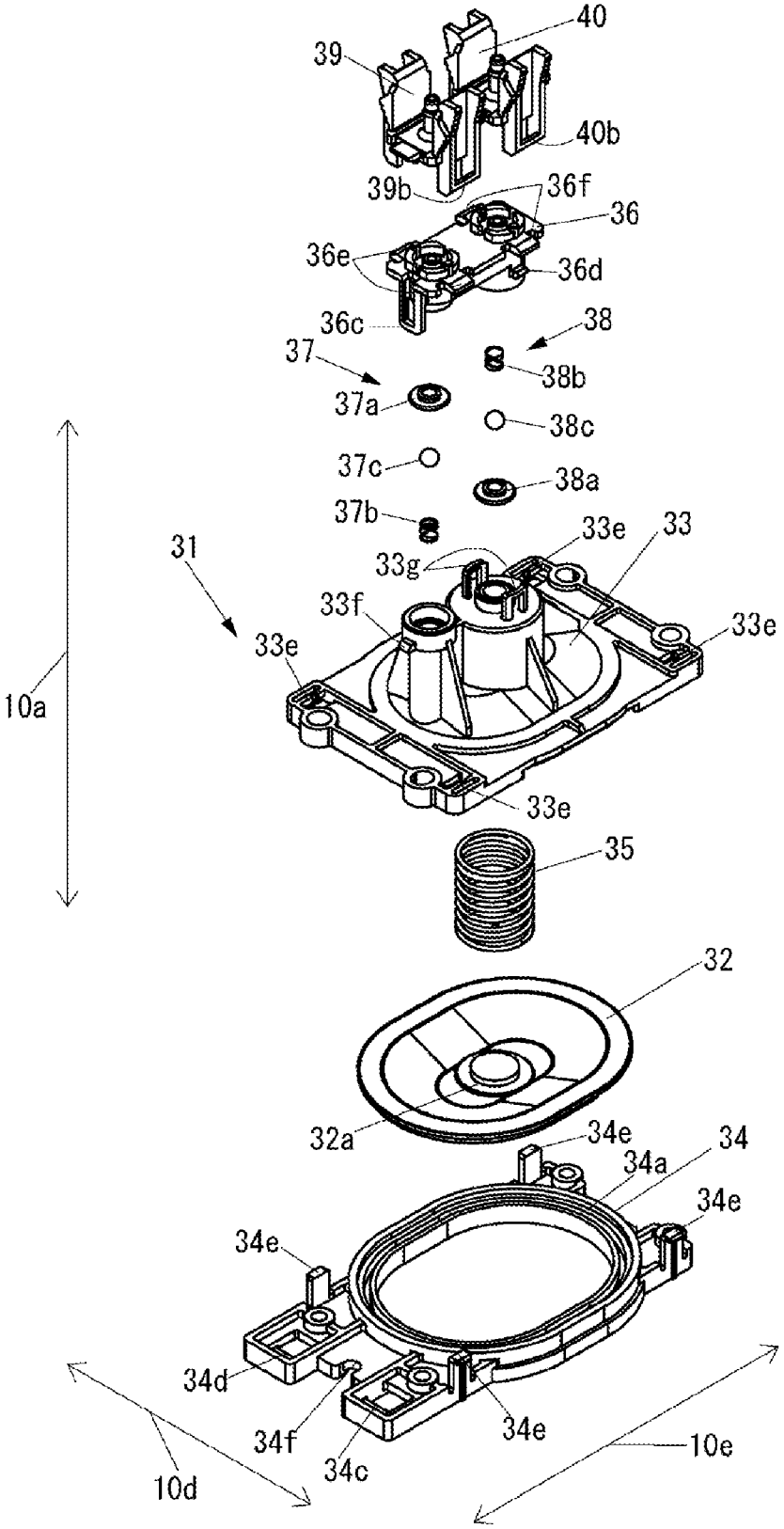
FIG. 6 is an exploded perspective view of a part of the diaphragm pump shown in FIG. 4.
Figure 7:
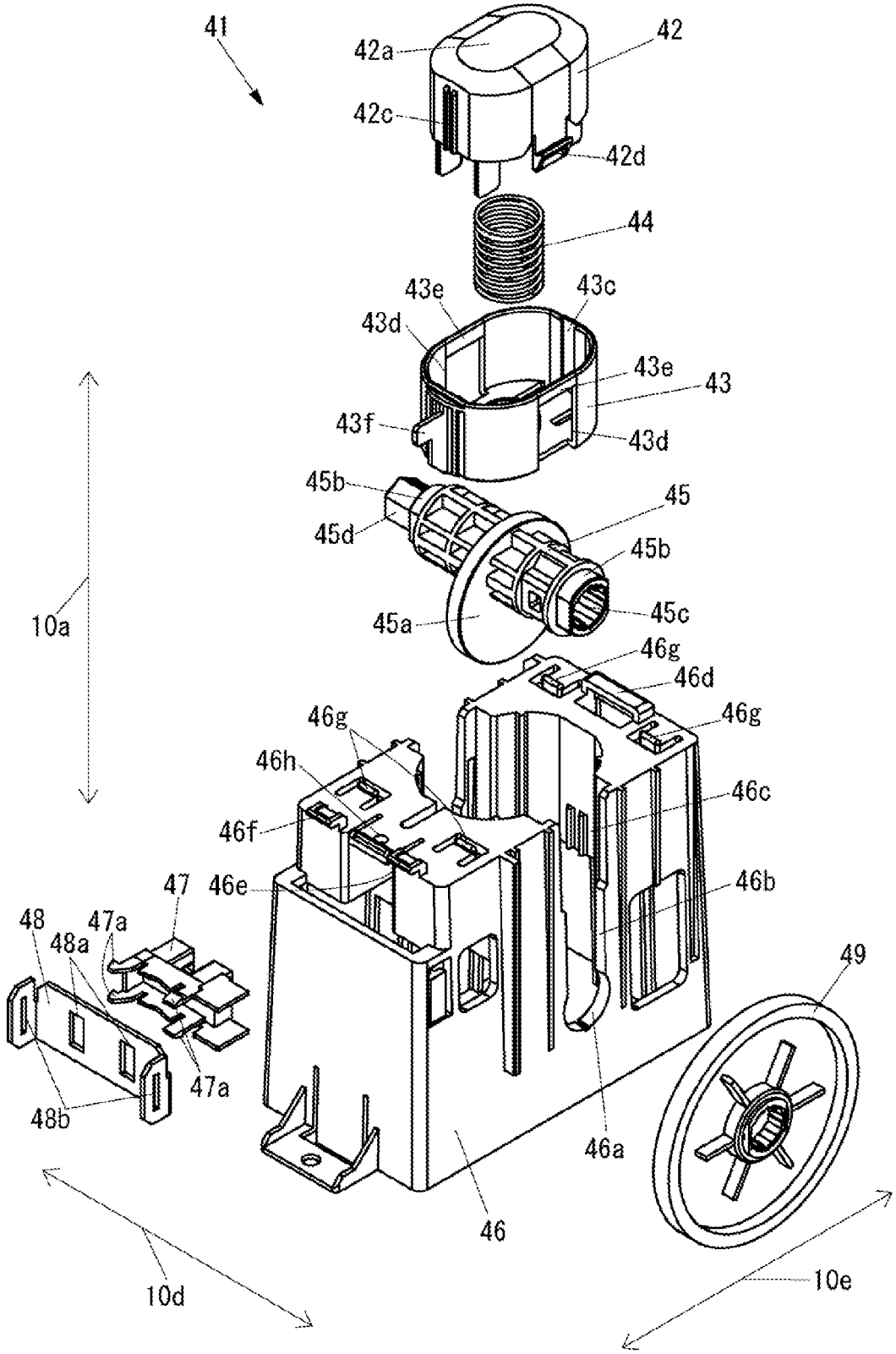
FIG. 7 is an exploded perspective view of a remaining part of the diaphragm pump shown in FIG. 4.
Figure 8:
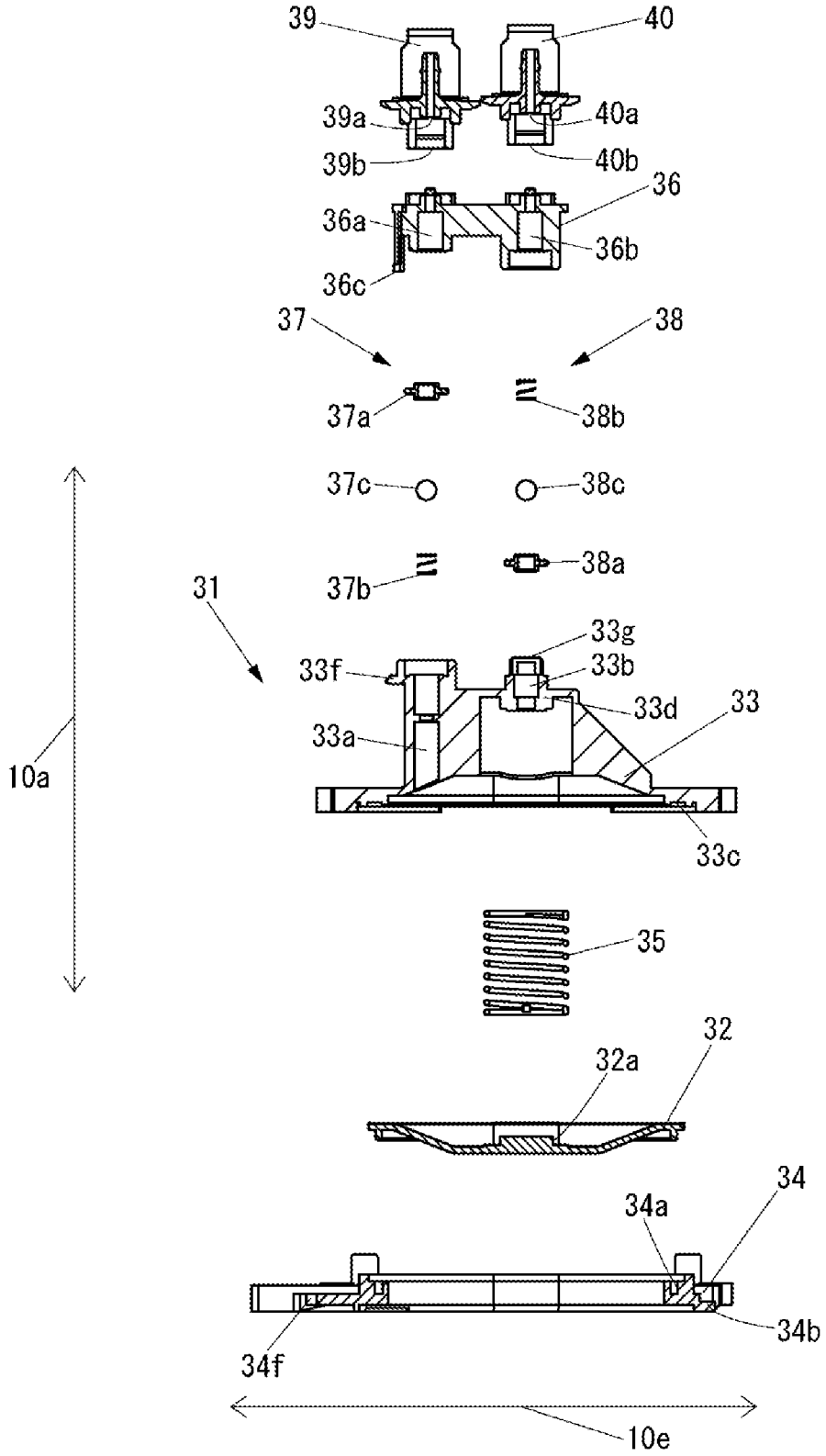
FIG. 8 is an exploded side cross-sectional view of a part of the diaphragm pump shown in FIG. 4.
Figure 9:
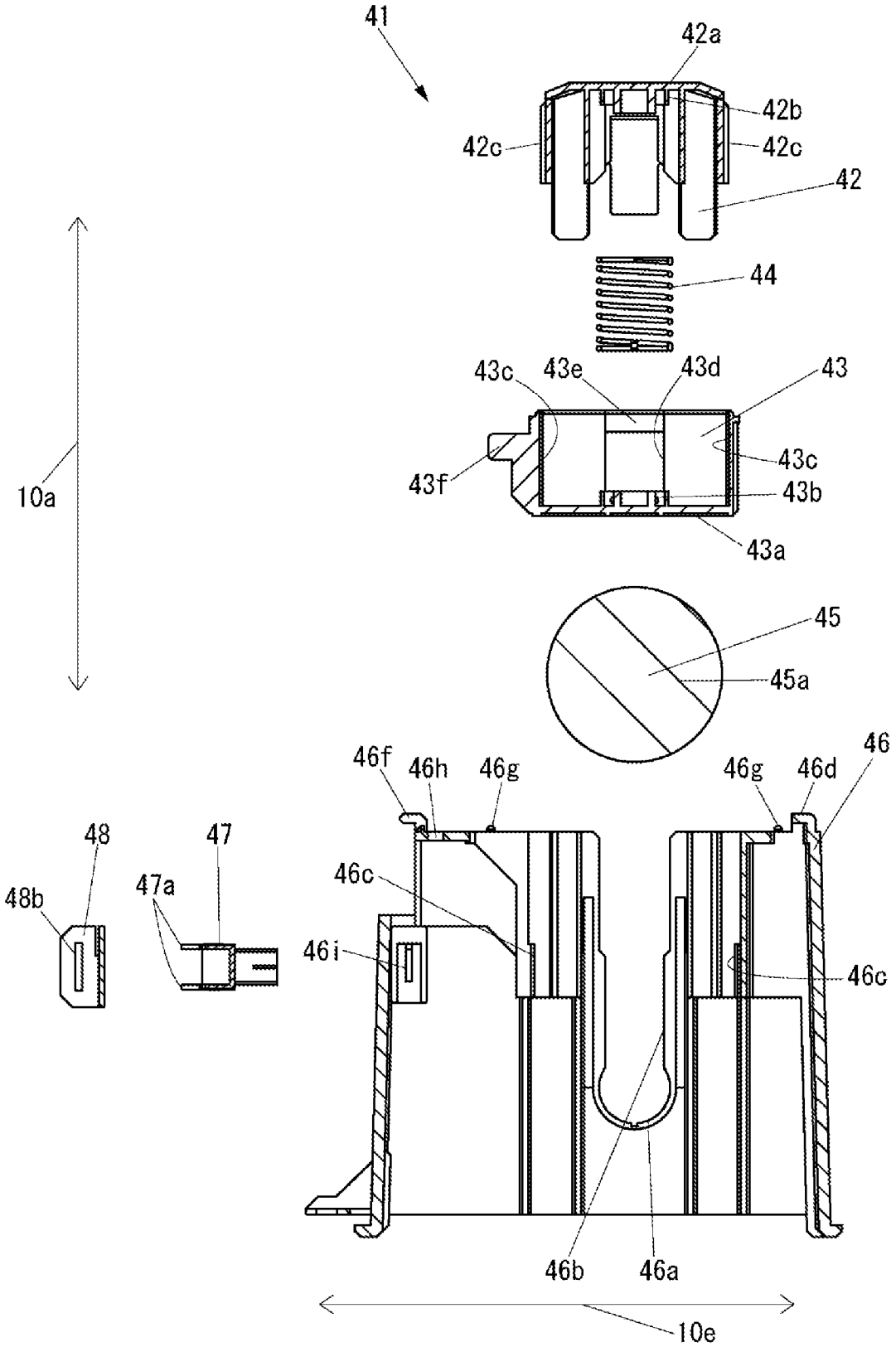
FIG. 9 is an exploded side cross-sectional view of a remaining part of the diaphragm pump shown in FIG. 4.

FIG. 4 is a perspective view of an outer appearance of the diaphragm pump 30. FIG. 5 is a side cross-sectional view of the diaphragm pump 30 in a state in which the ink storage chamber 31*a* is expanded and a pusher 41 is not in contact with the diaphragm 32. FIG. 6 is an exploded perspective view of a part of the diaphragm pump 30. FIG. 7 is an exploded perspective view of the remaining part of the diaphragm pump 30. FIG. 8 is an exploded side cross-sectional view of a part of the diaphragm pump 30. FIG. 9 is an exploded side cross-sectional view of the remaining part of the diaphragm pump 30.

FIG. 4 and FIG. 5 show the diaphragm pump 30 in a state mounted on the inkjet printer 10.

As shown in FIG. 4 to FIG. 9, the diaphragm pump 30 includes a diaphragm unit 31.

The diaphragm unit 31 includes the diaphragm 32, a storage chamber forming member 33 that constitutes the ink storage chamber 31*a* for storing ink together with the diaphragm 32, a diaphragm fixing member 34 that fixes the diaphragm 32 together with the storage chamber forming member 33, and a spring 35 that is disposed in the interior of the ink storage chamber 31*a* and biases the diaphragm 32 in a direction of expanding the volume of the ink storage chamber 31*a*.

The diaphragm 32 can be formed by various materials. For example, the diaphragm 32 may be formed by rubber or resin. The diaphragm 32 deteriorates with time under the influence of ink. The rate of deterioration of the diaphragm 32 differs depending on, for example, the material of the diaphragm 32 itself and the type of ink.

The diaphragm 32 includes a spring supporting portion 32*a* for supporting the spring 35.

The storage chamber forming member 33 and the diaphragm fixing member 34 can be formed by various materials. For example, the storage chamber forming member 33 and the diaphragm fixing member 34 are made of resin and are joined to each other by laser welding.

The storage chamber forming member 33 forms the flow paths 33*a* and 33*b* communicating with the ink storage chamber 31*a*. The storage chamber forming member 33 includes a diaphragm fixing portion 33*c* for fixing the diaphragm 32 in a state of being sealed with the diaphragm 32, a spring supporting portion 33*d* for supporting the spring 35, and four engagement portions 33*e* for engaging with the diaphragm fixing member 34, a claw 33*f* for engaging a flow path forming member to be described later, and two engagement portions 33*g* for engaging with the flow path forming member.

The diaphragm fixing member 34 includes a diaphragm fixing portion 34*a* for fixing the diaphragm 32 in a state of being sealed with the diaphragm 32, unit fixing portions 34*b*, 34*c*, and 34*d* for fixing the diaphragm unit 31 with respect to a housing, to be described later, and four claws 34*e* for engaging with the engagement portion 33*e* of the storage chamber forming member 33. The diaphragm fixing member 34 is formed with a groove 34*f* through which a screw shaft for fixing the diaphragm unit 31 with respect to the housing is passed.

The diaphragm pump 30 includes a flow path forming member 36 forming flow paths 36*a* and 36*b* respectively communicating with the flow paths 33*a* and 33*b* of the storage chamber forming member 33, a check valve 37 disposed between the storage chamber forming member 33 and the flow path forming member 36 to prohibit the flow of ink from the flow path 33*a* to the flow path 36*a*, a check valve 38 disposed between the storage chamber forming member 33 and the flow path forming member 36 to prohibit the flow of ink from the flow path 36*b* to the flow path 33*b*, an inflow port member 39 formed with a flow path 39*a* communicating with the flow path 36*a* of the flow path forming member 36 and connected with a tube (not shown) communicating with the degassing module 22 (see FIG. 2) and the circulation valve 25 (see FIG. 2), and an outflow port member 40 formed with a flow path 40*a* communicating with the flow path 36*b* of the flow path forming member 36 and connected with a tube (not shown) communicating with the inflow port member to be described later of the buffer 50 (see FIG. 3).

The flow path forming member 36 includes an engagement portion 36*c* for engaging with the claw 33*f* of the storage chamber forming member 33, two claws 36*d* for engaging with the two engagement portions 33*g* of the storage chamber forming member 33 respectively (only one is shown in view of the viewpoint in FIG. 4 and FIG. 6), two claws 36*e* for engaging with the inflow port member 39, and two claws 36*f* for engaging with the outflow port member 40.

The check valve 37 includes an O-ring 37*a* disposed between the storage chamber forming member 33 and the flow path forming member 36, a spring 37*b* disposed on the storage chamber forming member 33 side with respect to the O-ring 37*a*, and a ball 37*c* disposed between the O-ring 37*a* and the spring 37*b* and closing the flow path by being pressed against the O-ring 37*a* by the spring 37*b*.

The check valve 38 includes an O-ring 38*a* disposed between the storage chamber forming member 33 and the flow path forming member 36, a spring 38*b* disposed on the flow path forming member 36 side with respect to the O-ring 38*a*, and a ball 38*c* disposed between the O-ring 38*a* and the spring 38*b* and closing the flow path by being pressed against the O-ring 38*a* by the spring 38*b*.

The inflow port member 39 includes two engagement portions 39*b* for engaging with the two claws 36*e* of the flow path forming member 36 respectively.

The outflow port member 40 includes two engagement portions 40*b* for engaging with the two claws 36*f* of the flow path forming member 36, respectively.

The flow path forming member 36, the check valve 37, and the check valve 38 may be included in the diaphragm unit 31. Furthermore, the inflow port member 39 and the outflow port member 40 may also be included in the diaphragm unit 31.

The diaphragm pump 30 includes a pusher 41 that contacts the diaphragm 32 from the lower side in the vertical direction to push the diaphragm 32 upward in the vertical direction and a camshaft 45 that contacts the pusher 41 from the lower side in the vertical direction to push up the pusher 41 upward in the vertical direction. The pusher 41 and the camshaft 45 constitute a driving portion for driving the diaphragm 32.

The pusher 41 includes a diaphragm contacting member 42 for contacting the diaphragm 32, a pusher base 43 for contacting the camshaft 45, a spring 44 disposed in a space between the diaphragm contacting member 42 and the pusher base 43. The length of the pusher 41 in the vertical direction changes according to the expansion and contraction of the spring 44.

The diaphragm contacting member 42 includes a diaphragm contacting portion 42*a* for contacting the diaphragm 32 on the upper surface in the vertical direction of the central portion in the horizontal direction. The diaphragm contacting member 42 includes a spring supporting portion 42*b* for supporting the spring 44 on the lower surface in the vertical direction of the central portion in the horizontal direction. The diaphragm contacting member 42 includes a protruding portion 42*c* extending in the vertical direction on the outer sides of both ends in the direction indicated by the arrow 10*e* orthogonal to both the direction indicated by the arrow 10*a* and the direction indicated by the arrow 10*d*. The diaphragm contacting member 42 includes a claw 42*d* (only one is shown in view of the viewpoint in FIG. 7) for preventing separation from the pusher base 43 at both ends in the direction indicated by the arrow 10*d*.

The pusher base 43 includes a cam contacting portion 43*a* for contacting the camshaft 45 on the lower surface in the vertical direction of the central portion in the horizontal direction. The pusher base 43 includes a spring supporting portion 43*b* for supporting the spring 44 on the upper surface in the vertical direction of the central portion in the horizontal direction. The pusher base 43 includes a rail 43*c* extending in the vertical direction and guiding the protruding portion 42*c* of the diaphragm contacting member 42 on the inner side of both ends in the direction indicated by the arrow 10*e*. In the pusher base 43, a hole 43*d* into which the claw 42*d* of the diaphragm contacting member 42 is inserted is formed at both ends in the direction indicated by the arrow 10*d*. The pusher base 43 includes a separation preventing portions 43*e* that contacts the claw 42*d* of the diaphragm contacting member 42 to prevent separation from the diaphragm contacting member 42 at both ends in the direction indicated by the arrow 10*d*. The pusher base 43 includes a protruding portion 43*f* for being detected by a photosensor to be described later.

The camshaft 45 has an eccentric cam 45*a* for contacting the pusher base 43 at the middle in the direction indicated by the arrow 10*d*. The camshaft 45 includes a supported portion 45*b*, to be supported by the housing described later, on both sides in the direction indicated by the arrow 10*d*. The shape of the outer edge of the cross section of the supported portion 45*b* orthogonal to the direction indicated by the arrow 10*d* is the shape of the outer edge of a circle in which a part of the outer edge is missing. The camshaft 45 includes a coupling groove portion 45*c* for coupling to the camshaft 45 of another diaphragm pump 30 at one end in the direction indicated by the arrow 10*d*. The camshaft 45 includes a coupling protruding portion 45*d* for coupling to the camshaft 45 of another diaphragm pump 30 at the other end in the direction indicated by the arrow 10*d*. That is, the respective camshafts 45 of the plurality of diaphragm pumps 30 are coupled to the camshaft 45 of another diaphragm pump 30 in the extending direction indicated by the arrow 10*d*. When the coupling protruding portion 45*d* of another diaphragm pump 30 is inserted, the coupling groove portion 45*c* of the diaphragm pump 30 is formed to the shape and size in which the coupling protruding portion 45*d* cannot rotate with respect to the coupling groove portion 45*c* with the center shaft extending in the direction indicated by the arrow 10*d* as the center. Similarly, when the coupling protruding portion 45*d* of the diaphragm pump 30 is inserted to the coupling groove portion 45*c* of another diaphragm pump 30, the coupling protruding portion 45*c* is formed to the shape and size in which the coupling protruding portion 45*d* cannot rotate with respect to the coupling groove portion 45*c* with the center shaft extending in the direction indicated by the arrow 10*d* as the center. For example, the shape and size on the inner side in the cross section of the coupling groove portion 45*c* orthogonal to the direction indicated by the arrow 10*d* and the shape and size on the outer side in the cross section of the coupling protruding portion 45*d* orthogonal to the direction indicated by the arrow 10*d* are both regular hexagon and have substantially the same size.

The diaphragm pump 30 supports the pusher 41 and the camshaft 45, and includes a housing 46 to which the diaphragm unit 31 is detachable. The housing 46 is fixed to the unit base 71 (see FIG. 3) by, for example, screws (not shown).

The housing 46 includes a circular supporting groove portion 46*a* for supporting the supported portion 45*b* of the camshaft 45 at both ends in the direction indicated by the arrow 10*b*. The housing 46 includes a passage opening 46*b* for passing the supported portion 45*b* of the camshaft 45 from the upper side of the supporting groove portion 46*a* in the vertical direction to the supporting groove portion 46*a* in the vertical direction at both ends in the direction indicated by the arrow 10*b*. The width of the passage opening 46*b* in the direction indicated by the arrow 10*e* at the coupling portion between the supporting groove 46*a* and the passage opening 46*b* is greater than or equal to a minimum width of the supported portion 45*b* of the camshaft 45 in the direction orthogonal to the direction indicated by the arrow 10*d* and smaller than the maximum width of the supported portion 45*b* of the camshaft 45 in the direction orthogonal to the direction indicated by the arrow 10*d*.

The housing 46 includes a pusher guiding portion 46*c* that contacts the pusher 41 in a direction indicated by the arrow 10*e* orthogonal to both the vertical direction indicated by the arrow 10*a* and the extending direction of the camshaft 45 indicated by the arrow 10*d* to guide the pusher 41 in the vertical direction at both sides of the pusher 41 in the direction indicated by the arrow 10*e*.

The housing 46 includes unit fixing portions 46*d*, 46*e*, and 46*f* for fixing the position of the diaphragm unit 31 in the vertical direction at the upper end in the vertical direction. The unit fixing portions 46*d*, 46*e*, and 46*f* also fix the position of the diaphragm unit 31 with respect to the housing 46 in the direction indicated by the arrow 10*d* and in one of the directions indicated by the arrow 10*e*. The unit fixing portions 46*d*, 46*e*, and 46*f* contact the unit fixing portions 34*b*, 34*c*, and 34*d* of the diaphragm fixing member 34, respectively, on the lower side in the vertical direction.

The housing 46 includes four claws 46*g* for fixing the position of the diaphragm unit 31 in the direction indicated by the arrow 10*e* at the upper end in the vertical direction. The four claws 46*g* are fitted to groove portions (not shown) formed on the surface of the lower end in the vertical direction of the diaphragm unit 31, thereby fixing the position of the diaphragm unit 31 in the direction indicated by the arrow 10*e*.

The housing 46 has a screw hole 46*h* for fixing the diaphragm unit 31 at the upper end in the vertical direction.

The housing 46 includes a protrusion 46*i* for supporting the photosensor, to be described later, on the inner side of both ends in the direction indicated by the arrow 10*d*.

The diaphragm pump 30 includes a photosensor 47 for detecting the position of the protruding portion 43*f* of the pusher base 43 and a photosensor fixing member 48 for fixing the photosensor 47 to the housing 46.

The photosensor 47 includes four claws 47*a* for engaging with the photosensor fixing member 48. The position of the pusher base 43 corresponds to the rotation angle of the camshaft 45. Therefore, the signal from the photosensor 47 indicating the position of the protruding portion 43*f* of the pusher base 43 can be used for determining the rotation angle of the camshaft 45.

The photosensor fixing member 48 includes two engagement portions 48*a* respectively engaging with two claws out of the four claws 47*a* of the photosensor 47 and two groove portions 48*b* into which the protrusion 46*i* of the housing 46 is inserted.

In the case where a plurality of diaphragm pumps 30 are coupled, the photosensor 47 and the photosensor fixing member 48 may be provided on only one of the plurality of diaphragm pumps 30 coupled to each other.

The diaphragm pump 30 includes a gear 49 for transmitting the power generated by the stepping motor 72 (see FIG. 3) to the camshaft 45.

In a case where a plurality of diaphragm pumps 30 are coupled, the gear 49 is provided only in the diaphragm pump closest to the stepping motor 72 among the plurality of diaphragm pumps 30 coupled to each other.

Here, a method of attaching the diaphragm unit 31 to the housing 46 will be described. Prior to attaching the diaphragm unit 31 to the housing 46, the housing 46 is supported by the supporting groove portion 46*a* after the supported portion 45*b* of the camshaft 45 is passed through the passage opening 46*b*, and then the pusher 41 Is inserted between the two pusher guiding portions 46*c* from the upper side in the vertical direction. When the unit fixing portions 34*b*, 34*c*, and 34*d* of the diaphragm fixing member 34 are not in contact with the housing 46, the diaphragm unit 31 is moved with respect to the housing 46 in a direction in which the unit fixing portion 34*b*, 34*c*, and 34*d* of the diaphragm fixing member 34 approach the unit fixing portions 46*d*, 46*e*, and 46*f* of the housing in the direction indicated by the arrow 10*e*, so that the unit fixing portions 34*b*, 34*c*, and 34*d* of the diaphragm fixing member 34 are brought into contact with the unit fixing portions 46*d*, 46*e*, and 46*f* of the housing 46. The four claws 46*g* are fitted to groove portions (not shown) formed on the surface of the lower end in the vertical direction of the diaphragm unit 31, so that the housing 46 fixes the position of the diaphragm unit 31 in the direction indicated by the arrow 10*e*. Therefore, the diaphragm unit 31 is fixed to the housing 46. Furthermore, in a state where the unit fixing portions 34*b*, 34*c*, and 34*d* of the diaphragm fixing member 34 are in contact with the unit fixing portions 46*d*, 46*e*, and 46*f* of the housing 46, the diaphragm unit 31 may be securely fixed to the housing 46 by fitting the screw, of which shaft has been passed through the groove 34*f* of the diaphragm fixing member 34, to the screw hole 46*h* of the housing 46.

A method of detaching the diaphragm unit 31 from the housing 46 will be described. First, in a case where the diaphragm unit 31 is fixed to the housing 46 by screws, the diaphragm unit 31 can be detached from the housing 46 by removing the screws from the screw holes 46*h* of the housing 46. The diaphragm unit 31 is detached from the housing 46 by moving the unit fixing portions 34*b*, 34*c*, and 34*d* of the diaphragm fixing member 34 with respect to the housing 46 in a direction away from the unit fixing portions 46*d*, 46*e*, and 46*f* of the housing 46 in the direction indicated by the arrow 10*e*.

Figure 10:
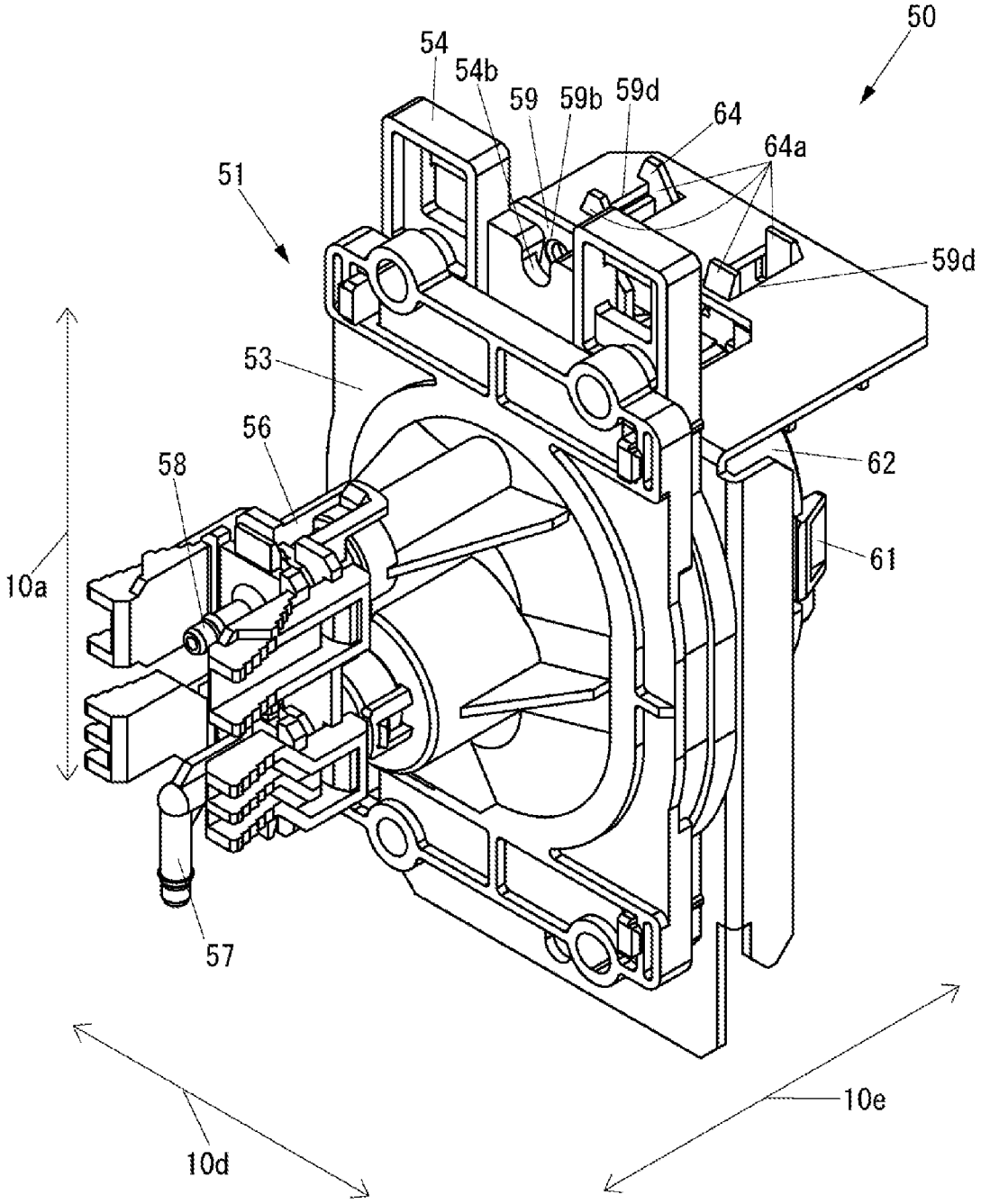
FIG. 10 is a perspective view of an outer appearance of the buffer shown in FIG. 3.
Figure 11:
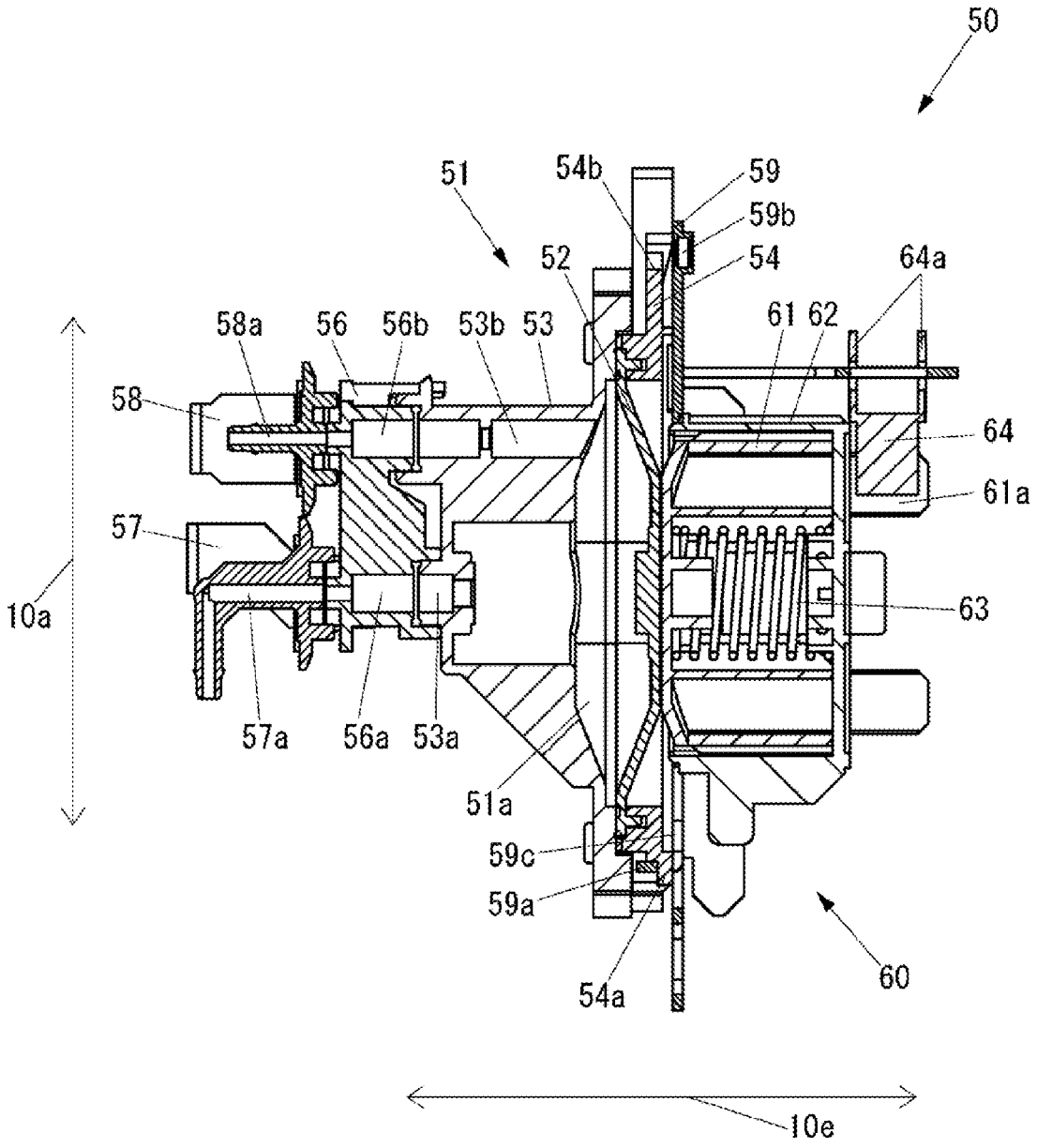
FIG. 11 is a side cross-sectional view of the buffer shown in FIG. 10 in a state in which the ink storage chamber is expanded.
Figure 12:
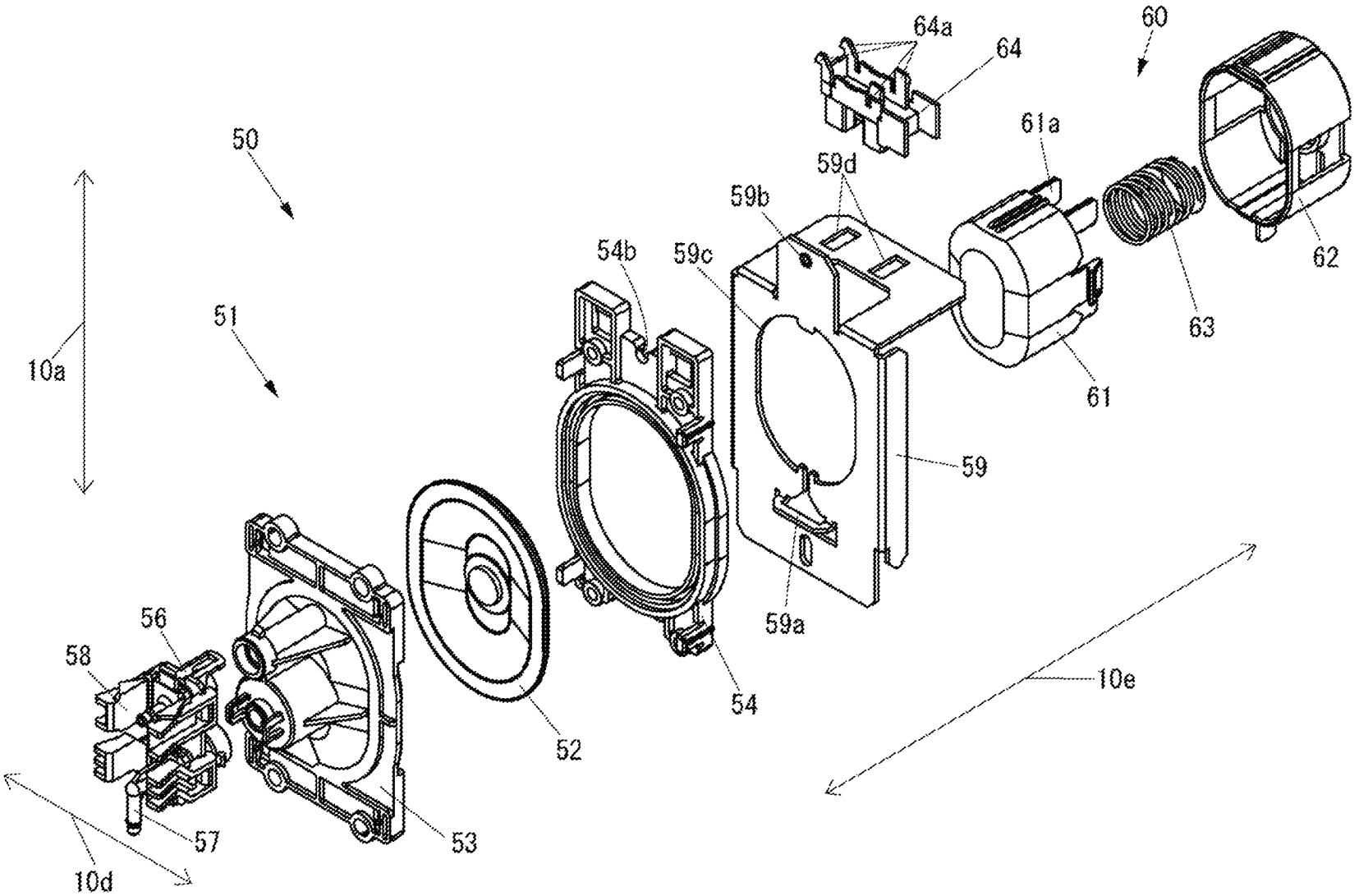
FIG. 12 is an exploded perspective view of the buffer shown in FIG. 10.
Figure 13:
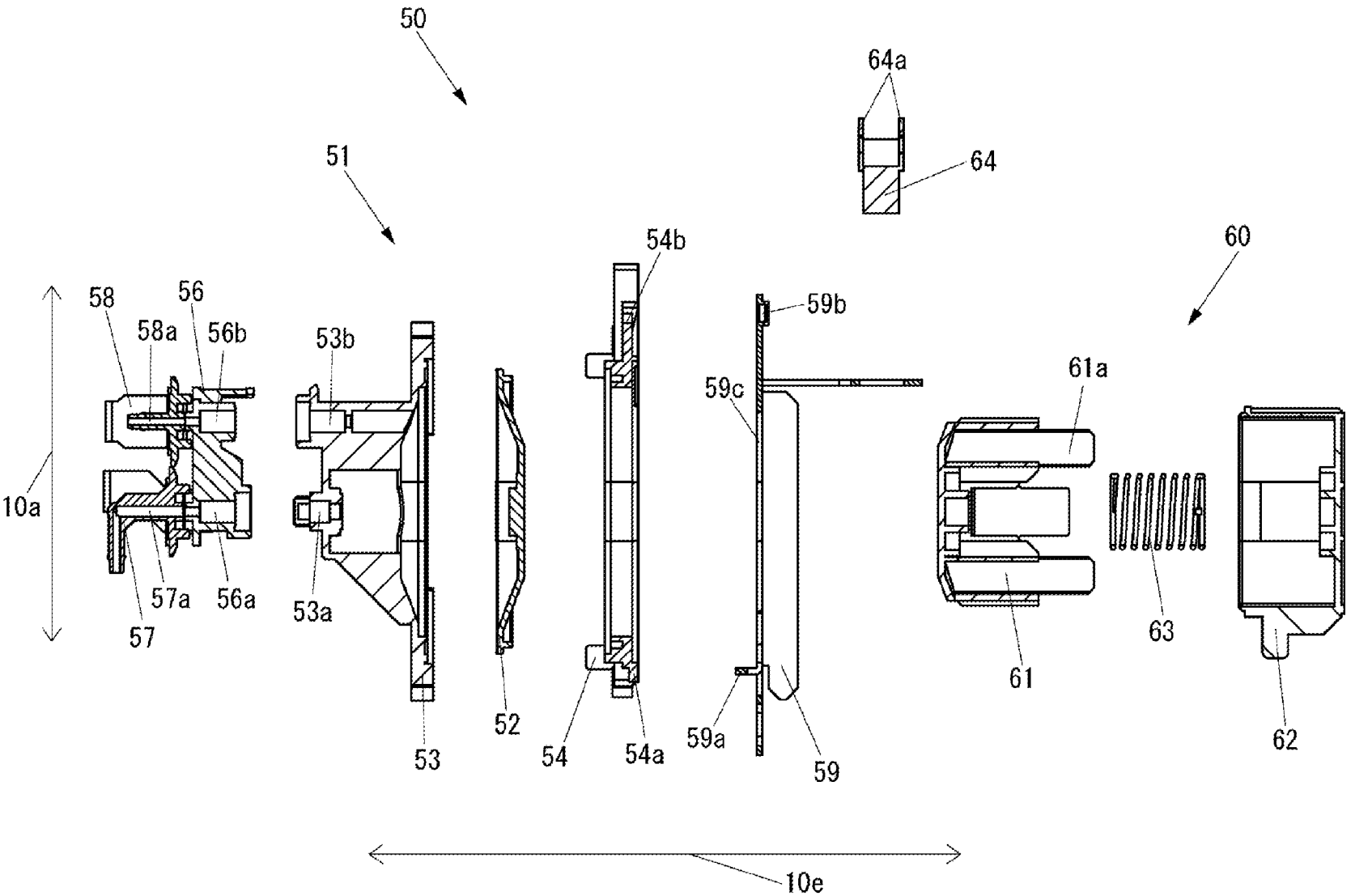
FIG. 13 is an exploded side cross-sectional view of the buffer shown in FIG. 10.

FIG. 10 is a perspective view of an outer appearance of the buffer 50. FIG. 11 is a side sectional view of the buffer 50 in a state in which an ink storage chamber 51*a* is expanded. FIG. 12 is an exploded perspective view of the buffer 50. FIG. 13 is an exploded side cross-sectional view of the buffer 50.

FIG. 10 and FIG. 11 show the buffer 50 in a state of being mounted in the inkjet printer 10.

As shown in FIG. 10 to FIG. 13, the buffer 50 includes a diaphragm unit 51.

The diaphragm unit 51 includes a diaphragm 52, a storage chamber forming member 53, and a diaphragm fixing member 54 similar to the diaphragm 32 (see FIG. 5) of the diaphragm pump 30 (see FIG. 3), the storage chamber forming member 33 (see FIG. 5), and the diaphragm fixing member 34 (see FIG. 5). The storage chamber forming member 53 constitutes an ink storage chamber 51*a* that stores ink together with the diaphragm 52. The storage chamber forming member 53 forms the flow paths 53*a* and 53*b* communicating with the ink storage chamber 51*a*. The diaphragm fixing member 54 includes a unit fixing portion 54*a* for fixing the diaphragm unit 51 to a buffer base to be described later. The diaphragm fixing member 54 is formed with a groove 54*b* through which a screw shaft for fixing the diaphragm unit 51 with respect to the buffer base is passed. The configuration of the diaphragm unit 51 is similar to the configuration in which the diaphragm unit 31 (see FIG. 5) does not include the spring 35 (see FIG. 5).

The buffer 50 includes a flow path forming member 56 forming flow paths 56*a* and 56*b* respectively communicating with the flow paths 53*a* and 53*b* of the storage chamber forming member 53, an inflow port member 57 formed with a flow path 57*a* communicating with the flow path 56*a* of the flow path forming member 56 and connected with a tube (not shown) communicating with the outflow port member 40 (see FIG. 4) of the diaphragm pump 30 (see FIG. 3), and an outflow port member 58 formed with a flow path 58*a* communicating with the flow path 56*b* of the flow path forming member 56 and connected with a tube (not shown) communicating with the damper 15 (see FIG. 2) and the circulation valve 25 (see FIG. 2). The structures of the flow path forming member 56 and the outflow port member 58 are similar to those of the flow path forming member 36 (see FIG. 5) and the outflow port member 40, respectively.

The flow path forming member 56 may be included in the diaphragm unit 51. Furthermore, the inflow port member 57 and the outflow port member 58 may also be included in the diaphragm unit 51.

The buffer 50 includes a buffer base 59 for fixing the buffer 50 to the unit base 71. The buffer base 59 is fixed to the unit base 71 (see FIG. 3) by, for example, a screw (not shown).

The buffer base 59 includes a unit fixing portion 59*a* for fixing the position of the diaphragm unit 51 in the direction indicated by the arrow 10*e*. The unit fixing portion 59*a* also fixes the position of the diaphragm unit 51 with respect to the buffer base 59 in the direction indicated by the arrow 10*d* and the downward direction in the vertical direction indicated by the arrow 10*a*. The unit fixing portion 59*a* contacts the unit fixing portion 54*a* of the diaphragm fixing member 54.

The buffer base 59 includes a screw hole 59*b* for fixing the diaphragm unit 51.

The buffer base 59 is formed with a pusher hole 59*c* into which a part of a pusher, described later, is inserted.

The buffer base 59 includes two engagement portions 59*d* for engaging with a photosensor described later.

The buffer 50 includes a pusher 60 that contacts the diaphragm 52 in the direction indicated by the arrow 10*e* and pushes the diaphragm 52 in the direction indicated by the arrow 10*e*. The pusher 60 includes a diaphragm contacting member 61, a pusher base 62, and a spring 63 similar to the diaphragm contacting member 42 (see FIG. 5), the pusher base 43 (see FIG. 5), and the spring 44 (see FIG. 5). That is, the configuration of the pusher 60 is similar to that of the pusher 41 (see FIG. 5). The pusher base 62 is fixed to the buffer base 59 by, for example, an adhesive. The role of the pusher 60 is to apply pressure to the ink stored in the ink storage chamber 51*a* to flow out toward the damper 15. Therefore, when the position of the buffer 50 is higher than the position of the damper 15, the buffer 50 may not include the pusher 60 in terms of the water head difference.

The buffer 50 includes a photosensor 64 for detecting the position of the protruding portion 61*a* of the diaphragm contacting member 61. The photosensor 64 includes four claws 64*a* for engaging with two engagement portions 59*d* of the buffer base 59 two at a time.

Here, a method of attaching the diaphragm unit 51 to the buffer base 59 will be described. When the unit fixing portion 54*a* of the diaphragm fixing member 54 is not in contact with the buffer base 59, the diaphragm unit 51 is moved with respect to the buffer base 59 in the downward direction in the vertical direction indicated by the arrow 10*a*, so that the unit fixing portion 54*a* of the diaphragm fixing member 54 is brought into contact with the unit fixing portion 59*a* of the buffer base 59. The diaphragm unit 51 is fixed to the buffer base 59 by fitting the screw, of which shaft is passed through the groove 54*b* of the diaphragm fixing member 54, to the screw hole 59*b* of the buffer base 59 in a state in which the unit fixing portion 54*a* of the diaphragm fixing member 54 is in contact with the unit fixing portion 59*a* of the buffer base 59.

A method of detaching the diaphragm unit 51 from the buffer base 59 will be described. The diaphragm unit 51 can be detached from the buffer base 59 by detaching the screw fixing the diaphragm unit 51 to the buffer base 59 from the screw hole 59*b* of the buffer base 59. Then, the diaphragm unit 51 is detached from the buffer base 59 by being moved with respect to the buffer base 59 in the upward direction in the vertical direction indicated by the arrow 10*a*.

Figure 14:
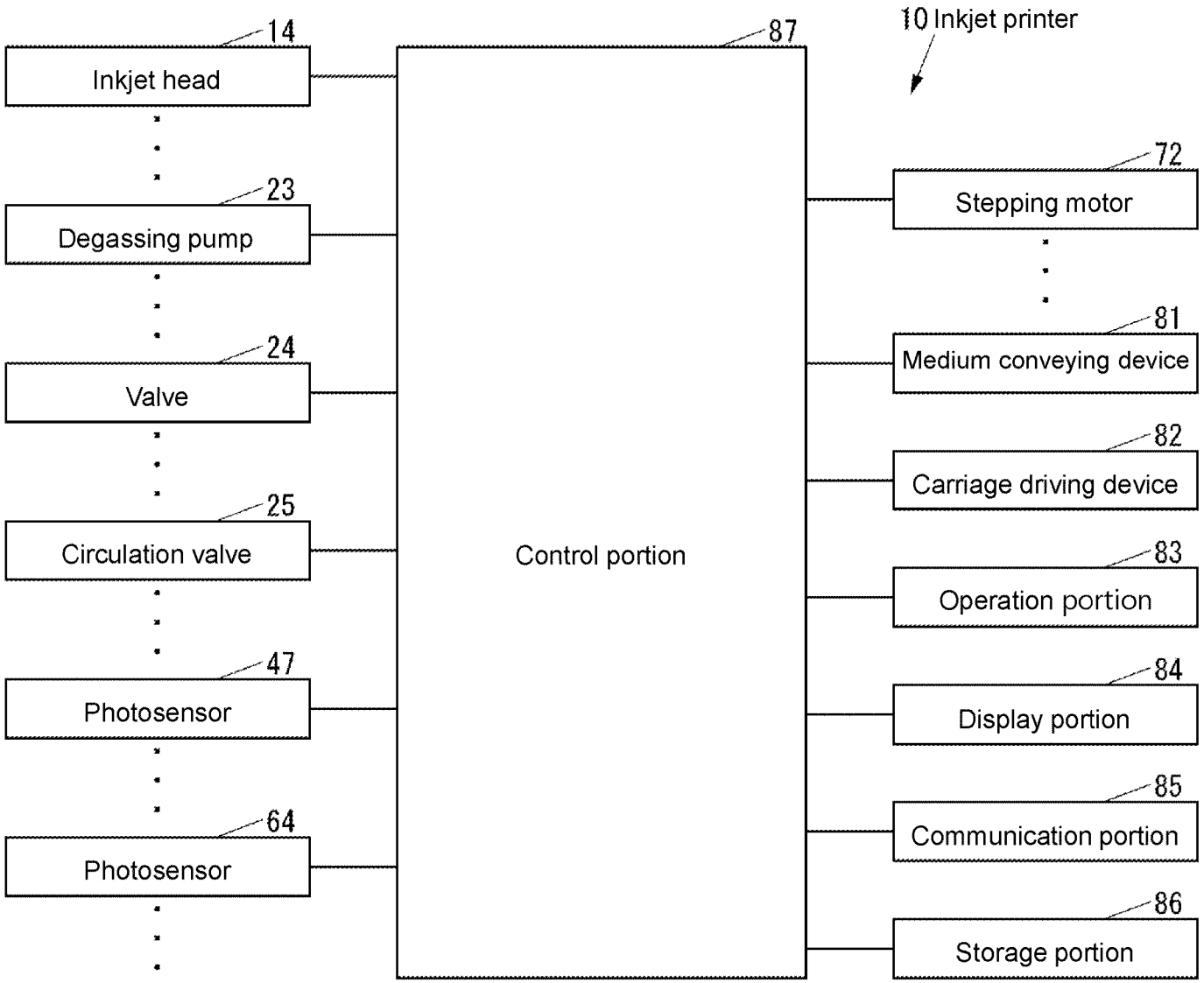
FIG. 14 is a block diagram of the inkjet printer shown in FIG. 1.

FIG. 14 is a block diagram of the inkjet printer 10.

As shown in FIG. 14, the inkjet printer 10 includes an inkjet head 14, a degassing pump 23, a valve 24, a circulation valve 25, a photosensor 47 of each pump unit 70, a photosensor 64 of each buffer 50 of each pump unit 70, a stepping motor 72 of each pump unit 70, a medium conveying device 81 for conveying the medium 90 (see FIG. 1) in the direction indicated by an arrow 10*c* (see FIG. 2), a carriage driving device 82 for moving the carriage 13 (see FIG. 1) in a direction indicated by the arrow 10*b* (see FIG. 1), an operation portion 83, which is an input device such as a button to which various operations are input, a display portion 84, which is a display device such as a liquid crystal display (LCD) for displaying various information, a communication portion 85, which is a communication device that communicates with an external device via a network or directly in a wired or wireless manner without passing the network, a storage portion 86, which is a nonvolatile storage device such as a semiconductor memory, a hard disk drive (HDD), and the like for storing various information, and a control portion 87 for controlling the entire inkjet printer 10.

The control portion 87 includes, for example, a central processing unit (CPU), a read only memory (ROM) that stores programs and various data, and a random access memory (RAM) used as a work area of the CPU. The CPU executes the program stored in the ROM or the storage portion 86.

Next, the operation of the inkjet printer 10 will be described.

First, the operation of the diaphragm pump 30 will be described.

Figure 15:
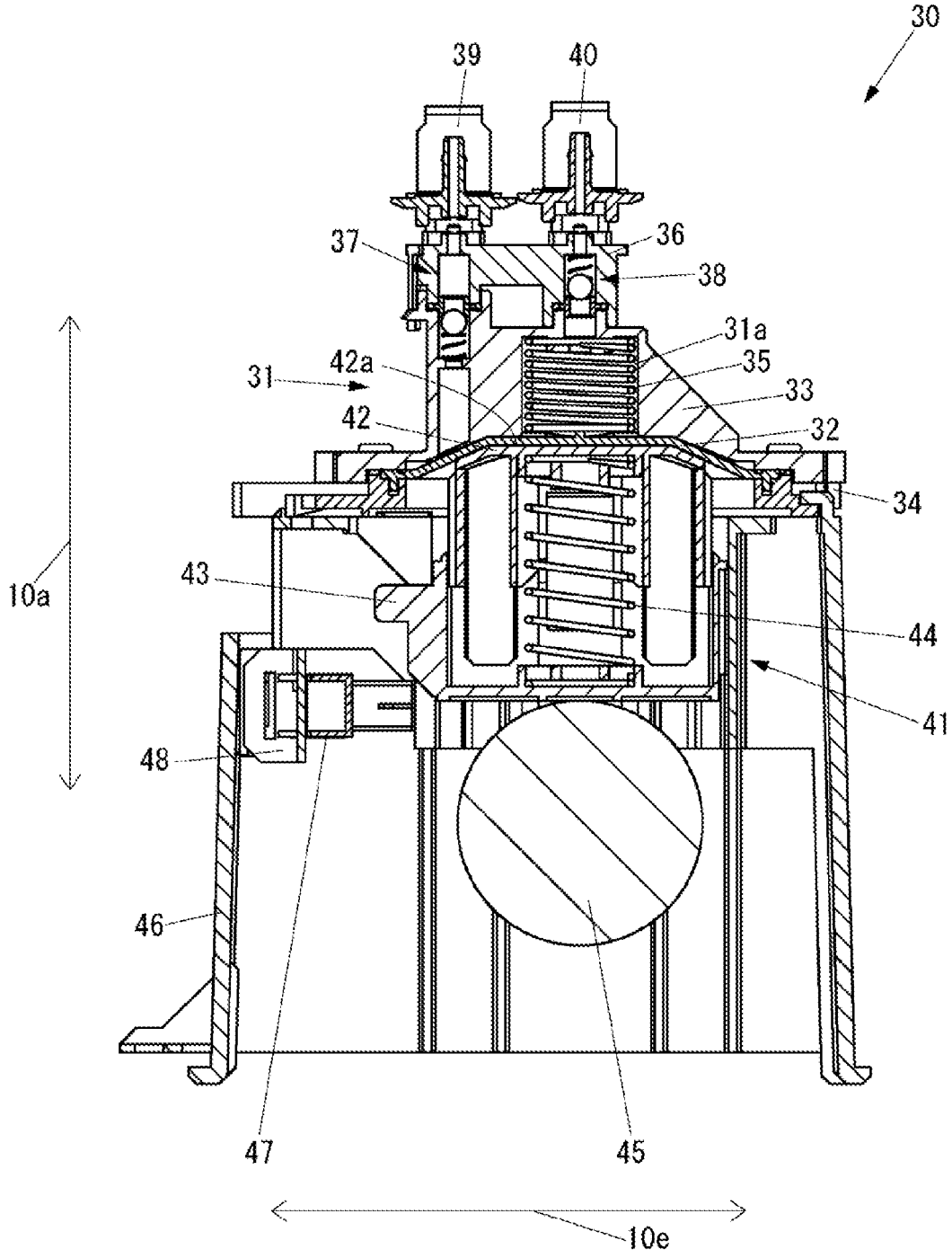
FIG. 15 is a side cross-sectional view of the diaphragm pump shown in FIG. 3 in a state in which the ink storage chamber is recessed and the pusher is in contact with the diaphragm.

FIG. 15 is a side cross-sectional view of the diaphragm pump 30 in a state in which the ink storage chamber 31*a* is recessed and the pusher 41 is in contact with the diaphragm 32.

When the stepping motor 72 is driven and the camshaft 45 is rotated, the diaphragm pump 30 repeats the state shown in FIG. 5 and the state shown in FIG. 15. In other words, the diaphragm pump 30 introduces ink from the outside of the diaphragm pump 30 to the inside of the ink storage chamber 31*a* through the inflow port member 39 when shifting from the state shown in FIG. 15 to the state shown in FIG. 5, and transfers the ink from the inside of the ink storage chamber 31*a* to the outside of the diaphragm pump 30, that is, the buffer 50 via the outflow port member 40 when shifting from the state shown in FIG. 5 to the state shown in FIG. 15.

Figure 16:
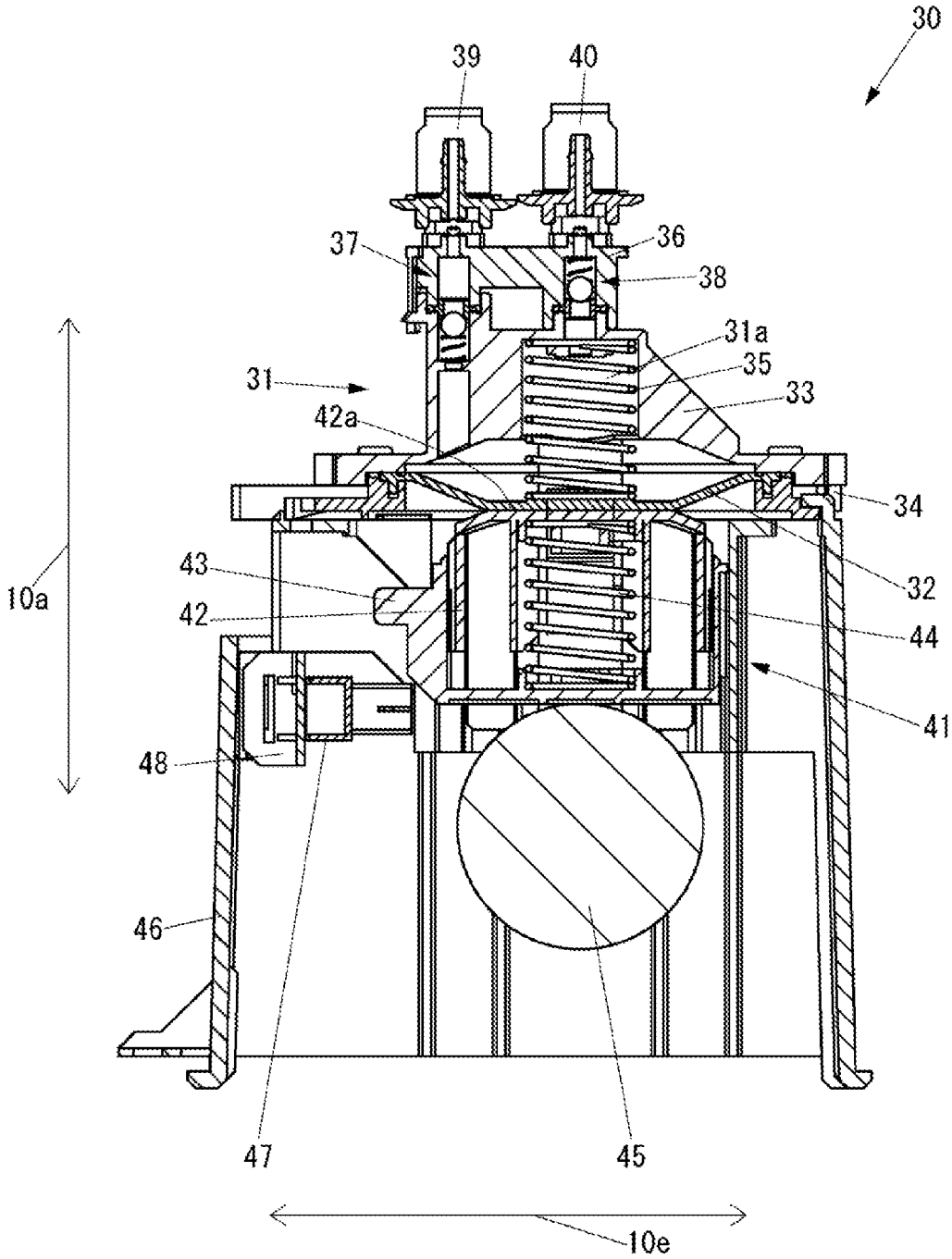
FIG. 16 is a side cross-sectional view of the diaphragm pump shown in FIG. 3 in a state in which the ink storage chamber is expanded and the pusher is in contact with the diaphragm.

However, when the pressure of the ink inside the ink storage chamber 31*a* becomes higher than or equal to a specific pressure such as when the ink storage chamber 51*a* of the buffer 50 is expanded to a maximum extent, the diaphragm pump 30 is in the state shown in FIG. 16 instead of the state shown in FIG. 15.

FIG. 16 is a side cross-sectional view of the diaphragm pump 30 in a state in which the ink storage chamber 31*a* is expanded and the pusher 41 is in contact with the diaphragm 32.

In the state shown in FIG. 16, the pusher 41 does not change the position of the diaphragm 32 as the length of the pusher 41 in the vertical direction indicated by the arrow 10*a* is shortened by the action of the spring 44. Therefore, the diaphragm pump 30 can suppress occurrence of an event in which "the pressure of the ink inside the ink storage chamber 31*a* becomes higher than or equal to a specific pressure and the inkjet printer 10 malfunctions".

Next, the operation of the buffer 50 will be described.

When the ink is transferred from the diaphragm pump 30, the buffer 50 introduces ink from the outside of the buffer 50, that is, from the diaphragm pump 30 to the inside of the ink storage chamber 51*a* via the inflow port member 57, and enters a state shown in FIG. 11.

When ink is ejected by the inkjet head 14, the buffer 50 transfers the ink from the inside of the ink storage chamber 51*a* to the outside of the buffer 50, that is, toward the inkjet head 14 through the outflow port member 58.

Figure 17:
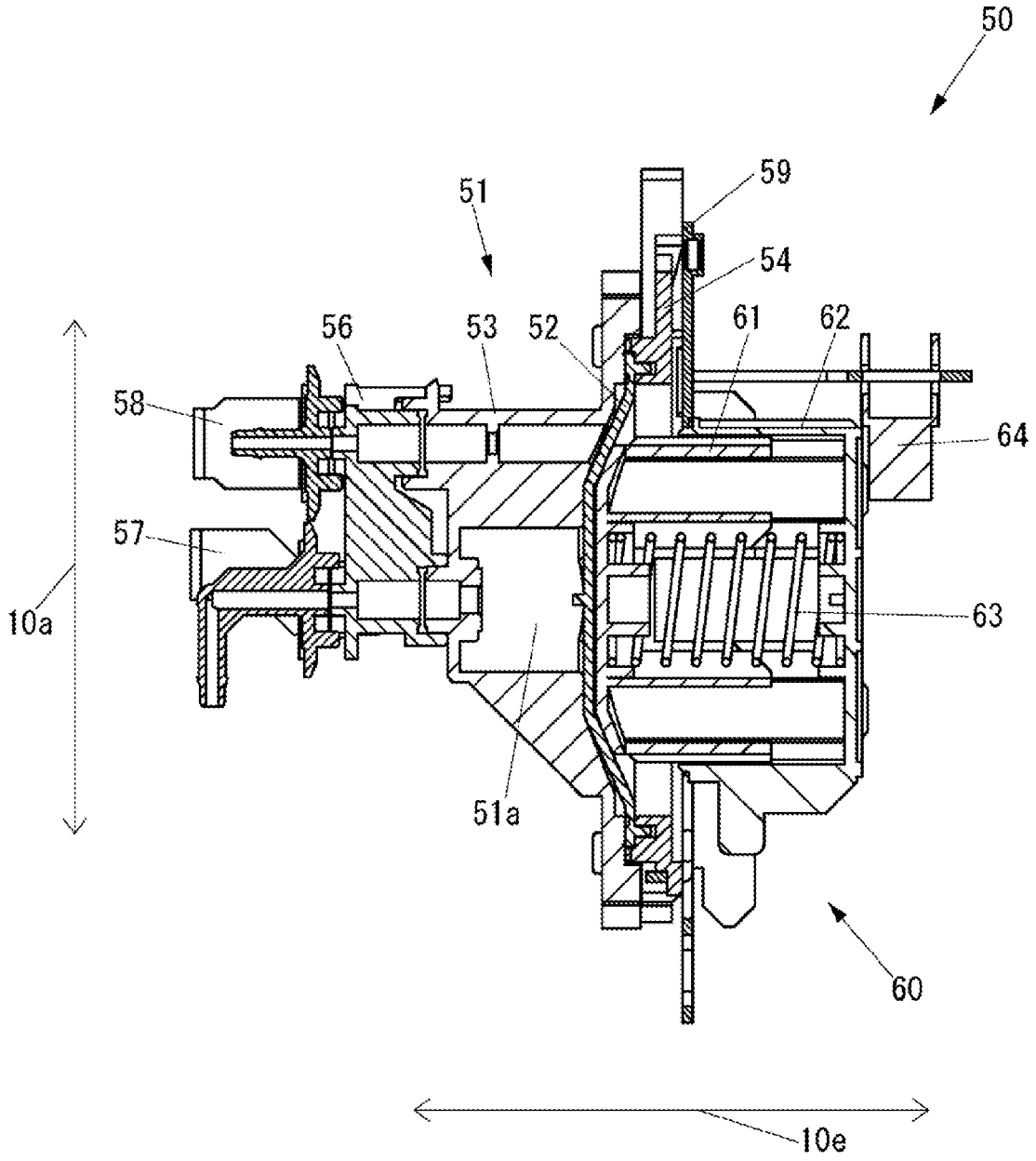
FIG. 17 is a side cross-sectional view of the buffer shown in FIG. 10 in a state in which the ink storage chamber is recessed.

FIG. 17 is a side cross-sectional view of the buffer 50 in a state in which the ink storage chamber 51*a* is recessed.

For example, even if the buffer 50 enters a state shown in FIG. 17 as a result of transferring the ink from the inside of the ink storage chamber 51*a* toward the inkjet head 14 through the outflow port member 58, the buffer again enters the state shown in FIG. 11 when the ink is transferred from the diaphragm pump 30.

Next, the operation of the inkjet printer 10 when executing printing will be described.

Upon receiving the print data through the communication portion 85, the control portion 87 executes printing on the medium 90 based on the print data received through the communication portion 85. That is, the control portion 87 moves the carriage 13 in the direction indicated by the arrow 10*b* by the carriage driving device 82 and ejects ink toward the medium 90 by the inkjet head 14 to execute printing on the medium 90 in the direction indicated by the arrow 10*b*. Furthermore, the control portion 87 changes the position of printing with respect to the medium 90 in the direction indicated by the arrow 10*c* by conveying the medium 90 in the direction indicated by the arrow 10*c* by the medium conveying device 81 every time the printing on the medium 90 in the direction indicated by the arrow 10*b* is executed.

The control portion 87 continues to drive the degassing pump 23 while executing printing. In addition, the control portion 87 closes the circulation valve 25 while executing printing.

In the case of stopping the stepping motor 72 after driving the stepping motor 72, the control portion 87 may stop the stepping motor 72 while the photosensor 47 is detecting the protruding portion 43*f* of the pusher base 43.

For the method of controlling the diaphragm pump 30 during printing, various methods can be conceived other than the four methods from the first method to the fourth method described below.

(1) First Method

The control portion 87 drives the stepping motor 72 and rotates the camshaft 45 once each time printing is executed on the medium 90 in the direction indicated by the arrow 10*b*. The control portion 87 can determine whether or not the camshaft 45 made one rotation based on a signal from the photosensor 47. The control portion 87 may open the valve 24 only while the stepping motor 72 is driven, or may open the valve 24 while executing printing.

(2) Second Method

The control portion 87 monitors the ejection amount of ink by the inkjet head 14, and drives the stepping motor 72 for a specific time when a specific amount is ejected. The control portion 87 may open the valve 24 only while the stepping motor 72 is driven, or may open the valve 24 while executing printing.

(3) Third Method

The control portion 87 drives the stepping motor 72 for a specific time when determining that a volume of the ink storage chamber 51*a* of the buffer 50 is smaller than or equal to a specific volume based on the signal from the photosensor 64. The control portion 87 may open the valve 24 only while the stepping motor 72 is driven, or may open the valve 24 while executing printing.

(4) Fourth Method

The control portion 87 opens the valve 24 and drives the stepping motor 72 while executing printing.

Next, the operation of the inkjet printer 10 when circulating ink will be described.

When determining that the specific condition for circulating the ink is satisfied, the control portion 87 closes the valve 24, opens the circulation valve 25, and drives the stepping motor 72. Therefore, the ink is transferred by the diaphragm pump 30 and circulates through a path constituted by a part of the path 20*a* and the circulation path 20*b*. It should be noted that the control portion 87 may open the valve 24 when circulating the ink.

As described above, in the diaphragm pump 30, when the supported portion 45*b* of the camshaft 45 is supported by the supporting groove portion 46*a* by causing the supported portion 45*b* of the camshaft 45 to pass through the passage opening 46*b*, the supported portion 45*b* of the camshaft 45 cannot exit from the passage opening 46*b* unless the rotation angle of the camshaft 45 is a specific angle, and thus the structure for suppressing the flapping of the camshaft 45 in the direction orthogonal to the extending direction of the camshaft 45, that is, the vertical direction can be simplified compared to the conventional structure.

In the diaphragm pump 30, the own weight of the camshaft 45 is applied on the camshaft 45 in a direction opposite to the moving direction of the camshaft 45 for the supported portion 45*b* of the camshaft 45 to exit from the supporting groove portion 46*a* to the passage opening 46*b*, and thus it becomes difficult for the supported portion 45*b* of the camshaft 45 to exit from the supporting groove portion 46*a* to the passage opening 46*b*, and as a result, the flapping of the camshaft 45 in the vertical direction can be more firmly suppressed.

In the diaphragm pump 30, the weight of the pusher is applied on the camshaft 45 in a direction opposite to the moving direction of the camshaft 45 for the supported portion 45*b* of the camshaft 45 to exit from the supporting groove portion 46*a* to the passage opening 46*b*, and thus it becomes difficult for the supported portion 45*b* of the camshaft 45 to exit from the supporting groove portion 46*a* to the passage opening 46*b*, and as a result, the flapping of the camshaft 45 in the vertical direction can be more firmly suppressed.

Figure 18:
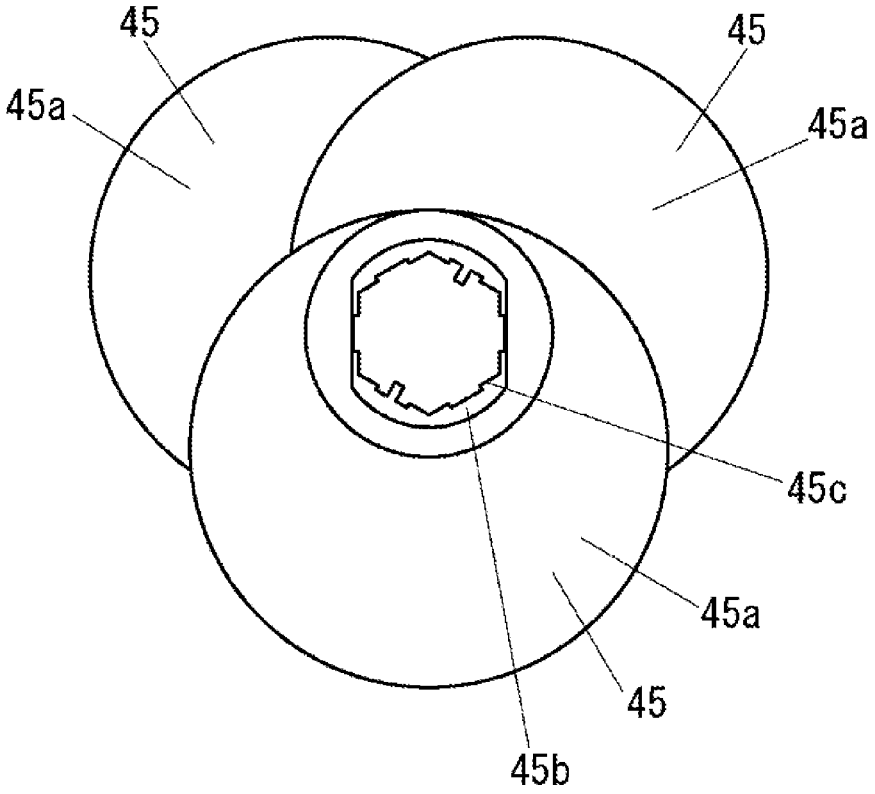
FIG. 18 is a schematic side view of a plurality of camshafts coupled in the pump unit shown in FIG. 3.

In the pump unit 70, the camshaft 45 of at least two diaphragm pumps 30 among the plurality of diaphragm pumps 30 may, for example, have the positions of the supported portions 45*b* in the rotating direction shifted from each other, as shown in FIG. 18.

FIG. 18 is a schematic side view of a plurality of camshafts 45 coupled in the pump unit 70.

In FIG. 18, the configuration other than the camshaft 45 is omitted. In the example shown in FIG. 18, the camshaft 45 in which the position of the supported portion 45*b* is shifted by 120° clockwise and the camshaft 45 in which the position of the supported portion 45*b* is shifted by 240° clockwise with respect to the camshaft 45 on the nearest side in the figure exist.

In the pump unit 70, in a case where the positions of the supported portions 45*b* in the rotating direction of the camshaft 45 of at least two diaphragm pumps 30 are shifted from each other, when the rotation angle of the camshaft 45 reaches an angle for the supported portion 45*b* of the camshaft 45 of any one diaphragm pump 30 to exit from the supporting groove portion 46*a* to the passage opening 46*b*, the rotation angle of the camshaft 45 does not become an angle for the supported portion 45*b* of the camshaft 45 of another at least one diaphragm pump 30 to exit from the supporting groove portion 46*a* to the passage opening 46*b*, and thus it becomes difficult for the supported portion 45*b* of the camshaft 45 to exit from the supporting groove portion 46*a* to the passage opening 46*b*, and as a result, the flapping of the camshaft 45 in the vertical direction can be more firmly suppressed.

In the above description, the passage opening 46*b* extends in the vertical direction. However, the passage opening 46*b* may extend in a direction other than the vertical direction as long as it is a direction orthogonal to the extending direction of the camshaft 45.

In the present embodiment, the inkjet printer 10 detects the position of the protruding portion 43*f* of the pusher base 43 with the photosensor 47. However, the inkjet printer 10 may detect the position of the protruding portion 43*f* of the pusher base 43 by a method other than the photosensor.

In the present embodiment, the inkjet printer 10 detects the position of the protruding portion 61*a* of the diaphragm contacting member 61 with the photosensor 64. However, the inkjet printer 10 may detect the position of the protruding portion 61*a* of the diaphragm contacting member 61 by a method other than the photosensor.

In the present embodiment, the inkjet printer 10 drives the diaphragm pump 30 by the stepping motor 72. However, the inkjet printer 10 may drive the diaphragm pump 30 by a method other than the stepping motor.

In the present embodiment, the inkjet printer 10 moves the medium 90 in the sub-scanning direction indicated with the arrow 10*c* with respect to the inkjet head 14 by conveying the medium 90 in the sub-scanning direction with respect to the platen 11. However, the inkjet printer 10 may move the inkjet head 14 in the sub scanning direction with respect to the medium 90 by extending the platen 11 in the sub scanning direction more than as shown in FIG. 1 and moving the rail 12 in the sub scanning direction with respect to the platen 11.

The diaphragm pump 30 is provided in the inkjet printer 10 in the present embodiment. However, the diaphragm pump 30 may be provided in a device other than the inkjet printer 10. For example, the diaphragm pump 30 may transfer fluids other than ink.

What is claimed is:

1. A diaphragm pump, comprising:

a diaphragm;

a camshaft, including a cam for driving the diaphragm; and a housing that rotatably supports the camshaft, wherein the camshaft comprises: a supported portion to be supported by the housing;

the housing comprises:

a supporting groove portion with a circular shape for supporting the supported portion, and a passage opening for passing the supported portion to the supporting groove portion in a direction orthogonal to an extending direction of the camshaft;

wherein a shape of an outer edge of a cross section of the supported portion orthogonal to the extending direction is a shape of an outer edge of a circle in which a part of the outer edge is missing; and a width of the passing opening at a coupling portion of the supporting groove portion and the passing opening is greater than or equal to a minimum width of the supported portion in the orthogonal direction and smaller than a maximum width of the supported portion in the orthogonal direction.

2. The diaphragm pump according to claim 1, wherein the passage opening extends from an upper side of the supporting groove portion in a vertical direction to the supporting groove portion in the vertical direction.

3. The diaphragm pump according to claim 2, further comprising:

a pusher for pushing the diaphragm in the vertical direction, wherein the cam contacts the pusher from a lower side in the vertical direction.

4. A pump unit, comprising:

a plurality of diaphragm pumps according to claim 1, wherein the camshaft of each of the plurality of diaphragm pumps is coupled to the camshaft of another diaphragm pump in the extending direction thereof, and the camshafts of at least two diaphragm pumps among the plurality of diaphragm pumps have positions of the supported portions in a rotating direction shifted from each other.

5. A pump unit, comprising:

a plurality of diaphragm pumps according to claim 2, wherein the camshaft of each of the plurality of diaphragm pumps is coupled to the camshaft of another diaphragm pump in the extending direction thereof, and the camshafts of at least two diaphragm pumps among the plurality of diaphragm pumps have positions of the supported portions in a rotating direction shifted from each other.

6. A pump unit, comprising:

a plurality of diaphragm pumps according to claim 3, wherein the camshaft of each of the plurality of diaphragm pumps is coupled to the camshaft of another diaphragm pump in the extending direction thereof, and the camshafts of at least two diaphragm pumps among the plurality of diaphragm pumps have positions of the supported portions in a rotating direction shifted from each other.

7. An inkjet printer, wherein an ink is transferred by the diaphragm pump according to claim 1.

8. An inkjet printer, wherein an ink is transferred by the diaphragm pump according to claim 2.

9. An inkjet printer, wherein an ink is transferred by the diaphragm pump according to claim 3.

10. An inkjet printer, wherein an ink is transferred by the pump unit according to claim 4.

11. An inkjet printer, wherein an ink is transferred by the pump unit according to claim 5.

12. An inkjet printer, wherein an ink is transferred by the pump unit according to claim 6.

* * * * *